US006612682B1

(12) United States Patent
Saito

(10) Patent No.: US 6,612,682 B1
(45) Date of Patent: Sep. 2, 2003

(54) PRESSURE GENERATING APPARATUS, PRINTING APPARATUS, AND METHOD FOR CONTROLLING PRINTING APPARATUS

(75) Inventor: Hiroyuki Saito, Inagi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/639,080

(22) Filed: Aug. 16, 2000

(30) Foreign Application Priority Data

Aug. 24, 1999 (JP) ..... 11-236292

(51) Int. Cl.[7] ..... B41J 2/165
(52) U.S. Cl. ..... 347/30; 347/23
(58) Field of Search ..... 347/30, 20–22, 347/32, 35, 23

(56) References Cited

U.S. PATENT DOCUMENTS 5,153,613 A * 10/1992 Yamaguchi et al. ..... 347/29
5,486,854 A * 1/1996 Uchida ..... 347/30

FOREIGN PATENT DOCUMENTS

EP 0 589 583 3/1994
EP 0 592 006 4/1994
EP 0 597 675 5/1994
EP 0 850 765 A2 * 7/1998 ..... 347/30
GB 2 284 576 A * 6/1995 ..... 347/30

OTHER PUBLICATIONS

European Search Report EP 00118079, De Groot, R Apr. 27, 2001.

* cited by examiner

*Primary Examiner*—Shih-wen Hsieh
(74) *Attorney, Agent, or Firm*—Fitzpatrick, Cella, Harper & Scinto

(57) ABSTRACT

The present invention appropriately determines a point of time when a pressurization member such as a pump roller starts squeezing an elastic tube, that is, a point of time when a tube pump starts to generate pressure. The present invention thereby provides a pressure generating apparatus that can stably generate pressure without increasing costs, a printing apparatus including this pressure generating apparatus, and a method for controlling this printing apparatus. To achieve this, a tube pump is provided that operates after a pump roller acting as a pressurization member has come in pressure contact with a tube, to allow the pump roller to squeeze the tube to generate pressure therein. Then, after the pump roller has moved a predetermined amount to come in pressure contact with the tube, movement of the pump roller is stopped. Subsequently, a valve lever is allowed to perform a closing operation and the pump roller is then moved again. When a cap for introducing negative pressure from the tube pump is shut off from atmosphere due to the closing operation of the valve lever, negative pressure from the tube pump can be introduced.

15 Claims, 27 Drawing Sheets

PRESSURE GENERATING APPARATUS, PRINTING APPARATUS, AND METHOD FOR CONTROLLING PRINTING APPARATUS

This application is based on Japanese Patent Application No. 11-236292 (1999) filed Aug. 24, 1999, the content of which is incorporated hereinto by reference.

BACKGROUND OF THE INVENTION

1. Field of the Invention

The present invention relates to a pressure generating apparatus comprising a tube pump for squeezing an elastic tube to generate pressure therein, a printing apparatus including this pressure generating apparatus, and a method for controlling this printing apparatus.

The present invention is applicable to general printing apparatuses, apparatuses such as copying machines, facsimile machines having a communication system, and word processors having a printing section, as well as industrial printing apparatuses combined with various processing apparatuses in a compound manner.

2. Description of the Related Art

Printing apparatuses include those having functions of printers, copying machines, facsimile machines, or the like, or those used as output equipment for compound electronic equipment including a computer or a word processor or for work stations. These printing apparatuses are configured to images on printing media such as paper or thin plastic sheets.

Of these printing apparatuses, an ink jet type (ink jet printing apparatuses) carries out printing by ejecting ink onto a printing medium from a printing head acting as printing means. This ink jet printing apparatus has the advantages of allowing the printing head to be compactified easily, being able to print high-definition images at a high speed, being able to print images on plain paper without any special processing, and requiring reduced running costs. In addition, since this ink jet printing apparatus is based on the non-impact type, it makes reduced noise and can easily print color images using a large number of color inks. Alternatively, line type ink jet printing apparatuses using a line type printing head with a large number of nozzles arranged in a sheet width direction of printing paper can carry out printing at a higher speed.

In particular, ink jet type printing means (printing head) for using thermal energy to eject ink can be manufactured using a semiconductor fabrication process such as etching, deposition, or sputtering. Such printing means can further be compactified because liquid paths (nozzles) can be densely arranged therein by forming thermoelectric converters, electrodes, liquid path walls, roofs, or the like on a substrate.

The ink jet printing apparatus print an image on a printing medium by ejecting ink from the nozzles in response to electric signals. Entry of air into a nozzle or an increase in ink viscosity due to drying may preclude the nozzle from ejecting an ink droplet in response to electric signal. To recover the nozzle which cannot eject the ink properly, ink that does not contribute to image printing can be sucked and ejected from a tip of the nozzle (suction recovery). For this suction recovery means, a tube pump is often used as means for generating a negative pressure for sucking the ink. This tube pump generates a negative force inside a pump tube by rotating a pump roller in pressure contact with the pump tube, that is, squeezing the pump.

The suction recovery means comprises, for example, a cap that can cap the printing head and that has a suction port and an air communication port formed therein, the suction port being connected to a tube pump and the air communication port being connected to a valve rubber that is opened and closed by a valve lever. The cap and the tube pump are driven correlatively depending on a rotating direction of a PG motor, as shown, for example, by (a), (b), and (c) in FIG. 25. Additionally, the valve lever is driven depending on a rotating direction of a printing medium ejection roller rotated by an LF motor, as shown, for example, by (d) and (e) in FIG. 25.

First, the ejection roller is reversely driven for reverse rotation to cause the valve lever to open the valve rubber, and the PG motor subsequently rotates forward to bring the cap into abutment with a surface of the printing head which has the ink ejection port formed therein, to cap the printing head. At this point, the tube pump is forwardly driven for normal rotation due to the forward rotation (normal rotation) of the PG motor. The forward driving of the tube pump, however, prevents the pump roller from coming in pressure contact with the pump tube, so that the tube pump generates no negative force. Subsequently, the ejection roller is forwardly driven for normal rotation to cause the valve lever to close the valve rubber. Then, the PG motor rotates reversely to reversely drive the tube pump. When the tube pump is reversely driven for reverse rotation, the pump roller rotates in pressure contact with the pump tube to squeeze it to generate a negative force. This negative pressure is introduced into the cap through the suction port. Then, the cap caps the printing head and the air communication port is closed by the valve rubber, so that the negative pressure introduced into the cap causes ink of increased viscosity which is no longer suitable for printing as well as bubbles to be forcibly sucked and ejected from the ink ejection port of the printing head.

Subsequently, the ejection roller is reversely driven for reverse rotation to cause the valve lever to open the valve rubber. Then, the air communication port in the cap is opened to set the interior of the cap at atmospheric pressure. As a result, the ink is prevented from being sucked or ejected from the ink ejection port, while the ink inside the cap and the pump tube is sucked and ejected from an ink eject end of the pump tube (this operation is hereafter referred to as "idle suction"). Subsequently, the PG motor is stopped, and the ejection roller is forwardly driven for normal rotation to separate the cap from the ink ejection port forming surface of the printing head to release the capping to cause the valve lever to close the valve rubber. Then, the series of suction recovery operations are completed.

The pressure generating apparatus in the conventional suction recovery means described above, however, has the following problems:

(1) In FIG. 25, reference t0 denotes a rotation start time when the pump roller of the tube pump starts rotating and reference t1 denotes a pressure generation time when the pump roller comes in complete pressure contact with the pump tube to start generating pressure. The amount of rotation made by the PG motor between a rotation start time P0 and the pressure generation time t1 varies depending on the position of the pump roller at the point of rotation start time t0, that is, deviations in the initial positions of the pump roller. Consequently, pressure generated by the tube pump is unstable.

(2) The unstable pressure from the tube pump significantly varies the amount of ink sucked during the suction recovery operation.

(3) If detection means is provided to detect the initial position of the pump roller to take action based on results of the detection, the inclusion of the detection means increases costs for the entire apparatus.

SUMMARY OF THE INVENTION

It is an object of the present invention to stably generate pressure by appropriately determining a point of time when a pressurization member such as a pump roller starts squeezing an elastic tube, that is, a point of time when a tube pump starts to generate pressure. It is another object of the present invention to provide a pressure generating apparatus that does not increase costs, a printing apparatus including this pressure generating apparatus, and a method for controlling this printing apparatus.

In the first aspect of the present invention, there is provided a pressure generating apparatus including a tube pump for, when a pressurization member is moved in a predetermined direction, squeezing the tube with the pressurization member coming into pressure contact with an elastic tube, thereby generating in the tube a pressure to be introduced into a pressure introduction section, the apparatus comprising:

switching means for switching to a state where the pressure from the tube pump can or cannot be introduced into the pressure introduction section; and control means for allowing the switching means to switch to the state where the pressure from the tube pump can be introduced into the pressure introduction section after the pressurization member has moved a predetermined amount in the predetermined direction.

In the second aspect of the present invention, there is provided a printing apparatus that can print an image on a printing medium using a printing head capable of ejecting inks and that includes recovery means for effecting pressure on the printing head to eject ink that does not contribute to printing, from the printing head, the apparatus comprising:

the pressure generating means as claimed in claim 1 as a supply source of the pressure that is introduced into the recovery means.

In the third aspect of the present invention, there is provided a method for controlling a printing apparatus that can print an image on a printing medium using a printing head capable of ejecting ink and that includes recovery means for effecting pressure to the printing head to eject ink that do not contribute to printing, from the printing head, wherein:

a tube pump is provided as a supply source of pressure that is introduced into the recovery means, when a pressurization member is moved in a predetermined direction, the tube pump squeezes the tube with the pressurization member coming into pressure contact with an elastic tube, thereby generating in the tube a pressure to be introduced into the recovery means, after the pressurization member has moved a predetermined amount in the predetermined direction, a state is switched to one where the pressure from the tube pump can be introduced into the recovery means, from another where the pressure from the tube pump cannot be introduced into the recovery means.

The present invention comprises a tube pump including a pressurization member such as a pump roller that comes in pressure contact with an elastic tube and then squeezes it to generate pressure therein, wherein after the pressurization member has moved a predetermined amount, switching means switches to a state where the pressure from the tube pump can be introduced into a pressure introduction section. This allows adequate determination of a point of time when the pressurization member starts to squeeze the tube, that is, a point of time when the tube pump starts to generate pressure. As a result, the tube pump stably generates pressure, and an appropriate pressure can be introduced into the pressure introduction section such as a cap for a printing head of a printing apparatus to reliably provide an intended function such as ink suction recovery.

In addition, when the switching means switches to the state where the pressure from the tube pump can be introduced into the pressure introduction section, the movement of the pressurization member is temporarily stopped. Accordingly, after the operation of the switching means, the tube pump can be redriven to generate a stable pressure irrespective of variations in the amount of time required for the switching means to operate.

Additionally, a stable pressure can be generated without detection means for detecting the position of the pressurization member such as the pump roller. Accordingly, the absence of the detection means serves to reduce the costs of the apparatus.

The above and other objects, effects, features, and advantages of the present invention will become more apparent from the following description of embodiments thereof taken in conjunction with the accompanying drawings.

DETAILED DESCRIPTION OF THE PREFERRED EMBODIMENTS

Embodiments of the printing apparatus according to the present invention will be described by referring to the accompanying drawings.

In this specification, a word "print" (or "record") refers to not only forming significant information, such as characters and figures, but also forming images, designs or patterns on printing medium and processing media, whether the information is significant or insignificant or whether it is visible so as to be perceived by humans.

The word "print medium" or "print sheet" include not only paper used in common printing apparatus, but cloth, plastic films, metal plates, glass, ceramics, wood, leather or any other material that can receive ink. This word will be also referred to "paper".

Further, the word "ink" (or "liquid") should be interpreted in its wide sense as with the word "print" and refers to liquid that is applied to the printing medium to form images, designs or patterns, process the printing medium or process ink (for example, coagulate or make insoluble a colorant in the ink applied to the printing medium).

In the following description we take up as an example a printing apparatus using an ink jet printing system.

I. Fundamental Construction

By referring to FIGS. 1 to 18 a fundamental construction of a printer will be described.

I.1 Apparatus Body

Figure 1:
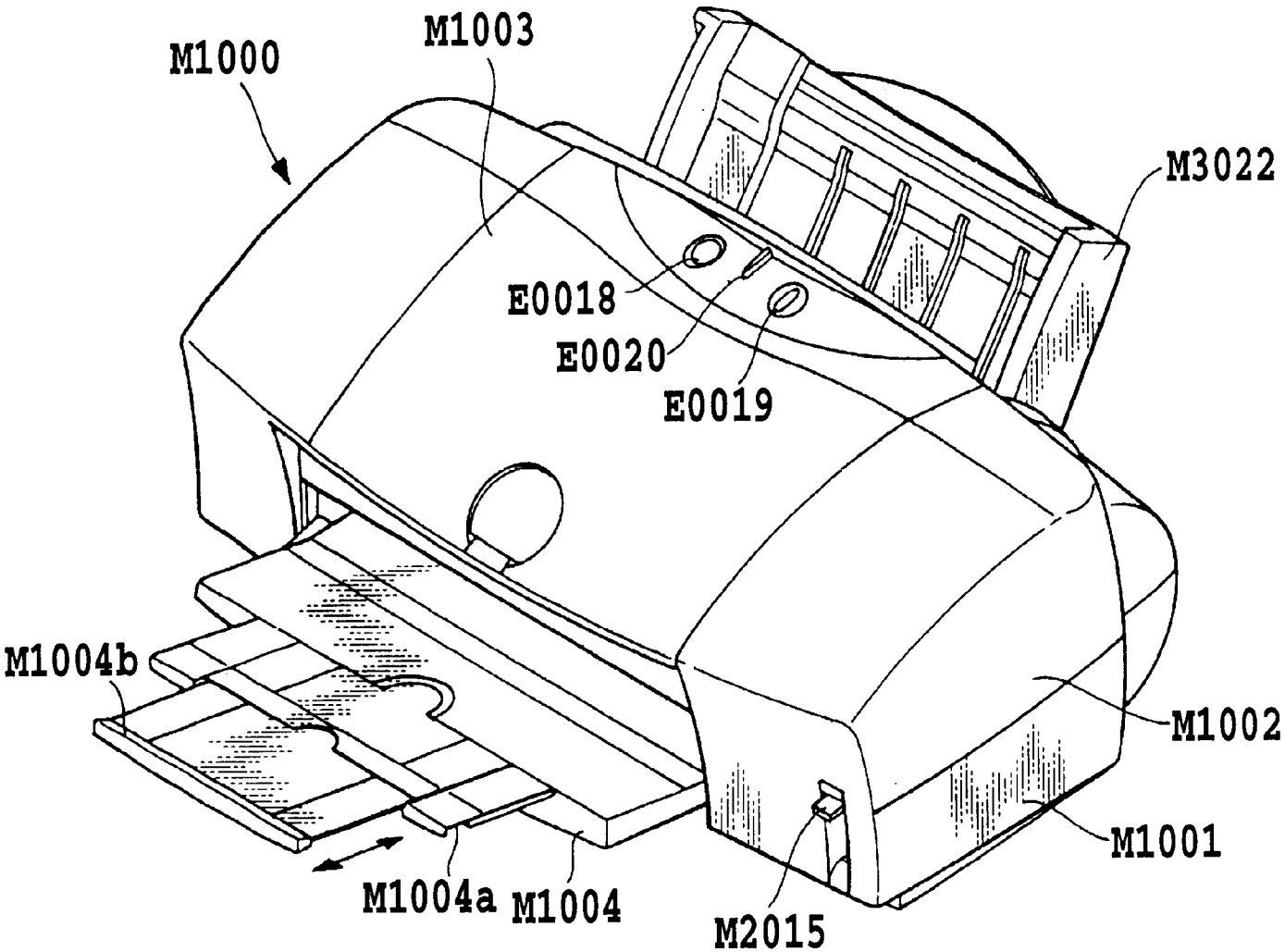
FIG. 1 is a perspective view showing an external construction of an ink jet printer as one embodiment of the present invention.
Figure 2:
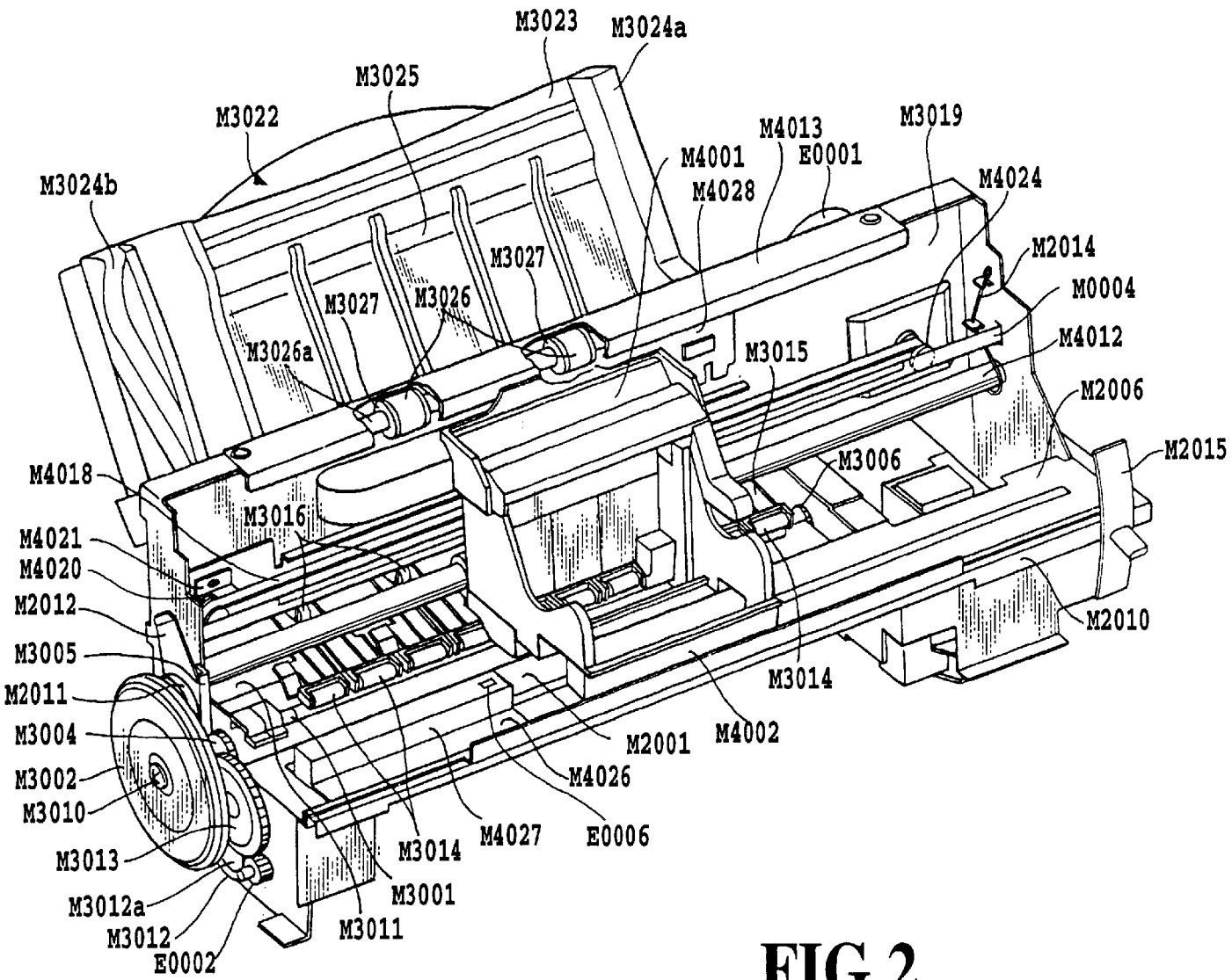
FIG. 2 is a perspective view showing the printer of FIG. 1 with an enclosure member removed.

FIGS. 1 and 2 show an outline construction of a printer using an ink jet printing system. In FIG. 1, a housing of a printer body M1000 of this embodiment has an enclosure member, including a lower case M1001, an upper case M1002, an access cover M1003 and a discharge tray M1004, and a chassis M3019 (see FIG. 2) accommodated in the enclosure member.

The chassis M3019 is made of a plurality of plate-like metal members with a predetermined rigidity to form a skeleton of the printing apparatus and holds various printing operation mechanisms described later.

The lower case M1001 forms roughly a lower half of the housing of the printer body M1000 and the upper case M1002 forms roughly an upper half of the printer body M1000. These upper and lower cases, when combined, form a hollow structure having an accommodation space therein to accommodate various mechanisms described later. The printer body M1000 has an opening in its top portion and front portion.

The discharge tray M1004 has one end portion thereof rotatably supported on the lower case M1001. The discharge tray M1004, when rotated, opens or closes an opening formed in the front portion of the lower case M1001. When the print operation is to be performed, the discharge tray M1004 is rotated forwardly to open the opening so that printed sheets can be discharged and successively stacked. The discharge tray M1004 accommodates two auxiliary trays M1004*a*, M1004*b*. These auxiliary trays can be drawn out forwardly as required to expand or reduce the paper support area in three steps.

The access cover M1003 has one end portion thereof rotatably supported on the upper case M1002 and opens or closes an opening formed in the upper surface of the upper case M1002. By opening the access cover M1003, a print head cartridge H1000 or an ink tank H1900 installed in the body can be replaced. When the access cover M1003 is opened or closed, a projection formed at the back of the access cover, not shown here, pivots a cover open/close lever. Detecting the pivotal position of the lever as by a micro-switch and so on can determine whether the access cover is open or closed.

At the upper rear surface of the upper case M1002 a power key E0018, a resume key E0019 and an LED E0020 are provided. When the power key E0018 is pressed, the LED E0020 lights up indicating to an operator that the apparatus is ready to print. The LED E0020 has a variety of display functions, such as alerting the operator to printer troubles as by changing its blinking intervals and color. Further, a buzzer E0021 (FIG. 15) may be sounded. When the trouble is eliminated, the resume key E0019 is pressed to resume the printing.

I.2 Printing Operation Mechanism

Next, a printing operation mechanism installed and held in the printer body M1000 according to this embodiment will be explained.

The printing operation mechanism in this embodiment comprises: an automatic sheet feed unit M3022 to automatically feed a print sheet into the printer body; a sheet transport unit M3029 to guide the print sheets, fed one at a time from the automatic sheet feed unit, to a predetermined print position and to guide the print sheet from the print position to a discharge unit M3030; a print unit M4000 to perform a desired printing on the print sheet carried to the print position; and an ejection performance recovery unit M5000 to recover the ink ejection performance of the print unit M4000.

Next, the construction of each mechanism will be explained.

I.2.1 Automatic Sheet Feed Unit

By referring to FIGS. 2 and 3 the automatic sheet feed unit M3022 will be described.

The automatic sheet feed unit M3022 in this embodiment horizontally feeds one of print sheets stacked at an angle of about 30–60 degrees to the horizontal plane, so that the sheet is discharged out of a sheet feed port not shown into the printer body while being kept in an almost horizontal attitude.

The automatic sheet feed unit M3022 includes feed rollers M3026, sheet guides M3024*a*, M3024*b*, a pressure plate M3025, an ASF base M3023, sheet separators M3027, and separation claws not shown. The ASF base M3023 forms a housing of the automatic sheet feed unit M3022 and is provided at the back of the printer body. On the front side of the ASF the pressure plate M3025 supporting the print sheets is mounted at an angle of about 30–60 degrees to the horizontal plane and a pair of sheet guides M3024*a*, M3024*b* that guide the ends of the print sheets project forwardly. One of the sheet guides M3024*b* is movable in the sheet width direction to conform to the horizontal size (width) of the sheets.

Rotatably supported on the left and right sides of the ASF base M3023 is a drive shaft M3026*a* that is connected through a gear not shown to a PG motor and which has rigidly secured thereto a plurality of feed rollers M3026 semicircular in cross section.

Figure 15:
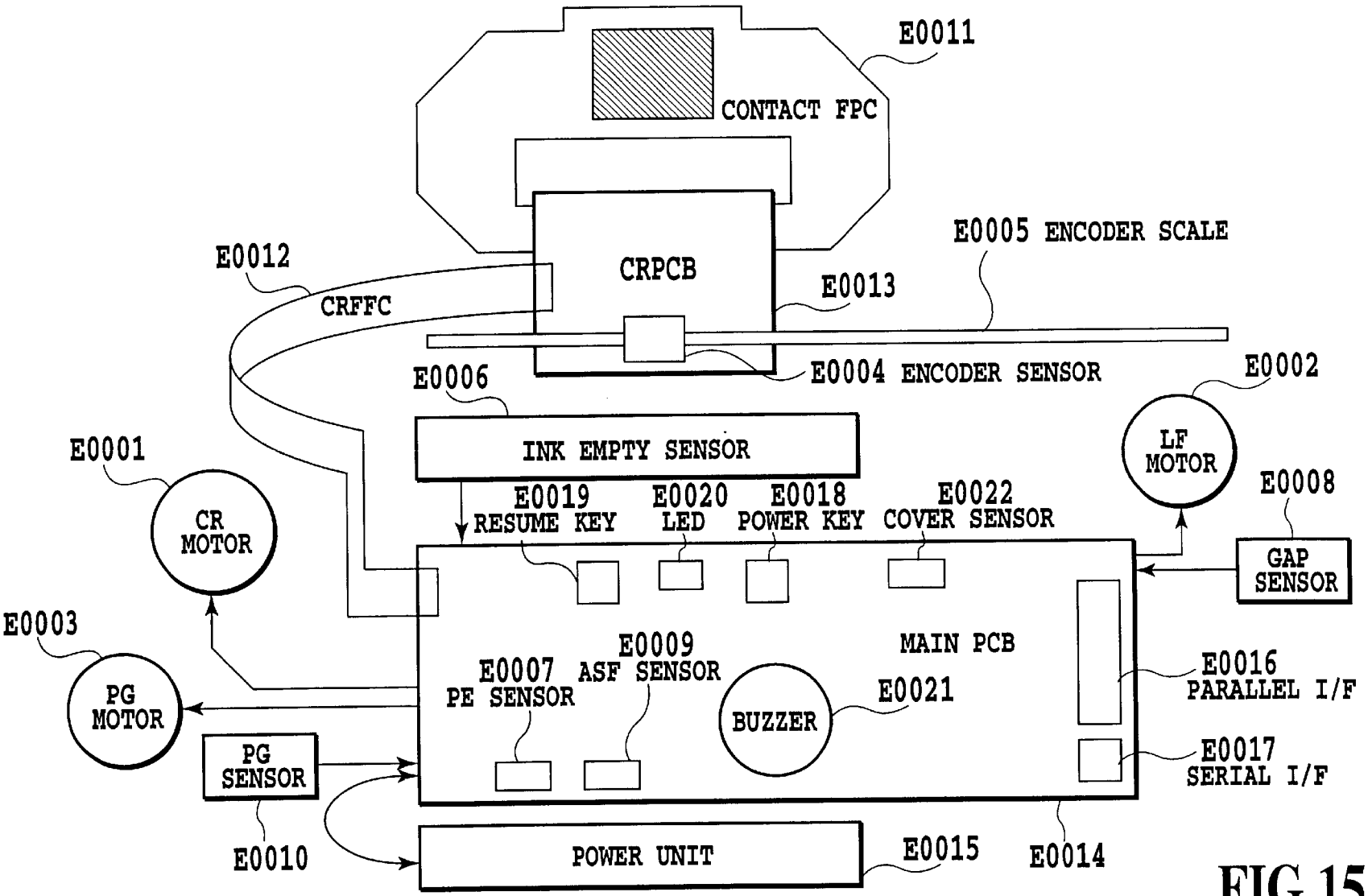
FIG. 15 is a block diagram schematically showing the overall configuration of an electric circuitry of the printer according to one embodiment of the present invention.

The print sheets stacked on the pressure plate M3025 are fed by the feed rollers M3026 that are driven by the PG motor E0003 (FIG. 15). The stacked sheets are separated one by one from the top of the stack by the sheet separators M3027 and the separation claws and forwarded to the paper transport unit M3029. The lower end of the pressure plate M3025 is resiliently supported by a pressure plate spring M3028 interposed between the pressure plate M3025 and the ASF base M3023, so that the contact force between the feed rollers and the sheet can be kept constant regardless of the number of sheets stacked.

Figure 3:
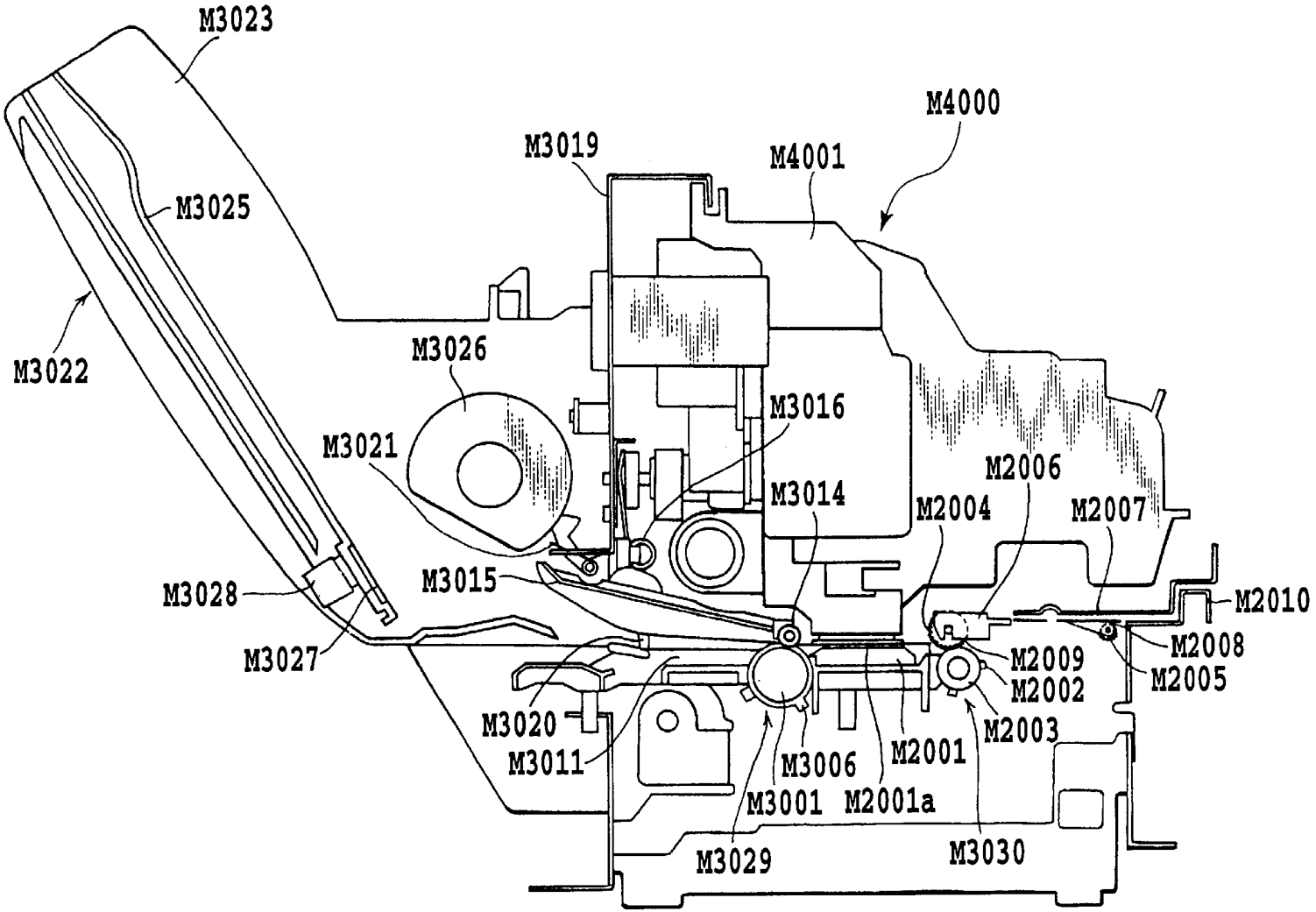
FIG. 3 is a side view of FIG. 2.

In a transport path from the automatic sheet feed unit M3022 to the paper transport unit M3029, a PE lever M3020 urged clockwise in FIG. 3 by a PE lever spring M3021 is pivotally mounted on a chassis M3019 which is secured to the printer body M1000 and formed of a metal plate member with a predetermined rigidity. When the print sheet separated and fed from the automatic sheet feed unit M3022 moves along the path and its front end abuts against one end of the PE lever and pivots it, a PE sensor not shown senses the rotation of the PE lever M3020, detecting that the print sheet has entered into the transport path.

After the entrance into the transport path of the print sheet has been detected, the print sheet is transported a predetermined distance downstream by the feed rollers M3026. That is, the print sheet is fed until its front end contacts a nip portion formed by an LF roller M3001, which is at rest and provided in the paper transport unit described later, and pinch rollers M3014 and the print sheet deflects about 3 mm in loop, at which time the sheet is stopped.

I.2.2 Paper Transport Unit

Figure 4:
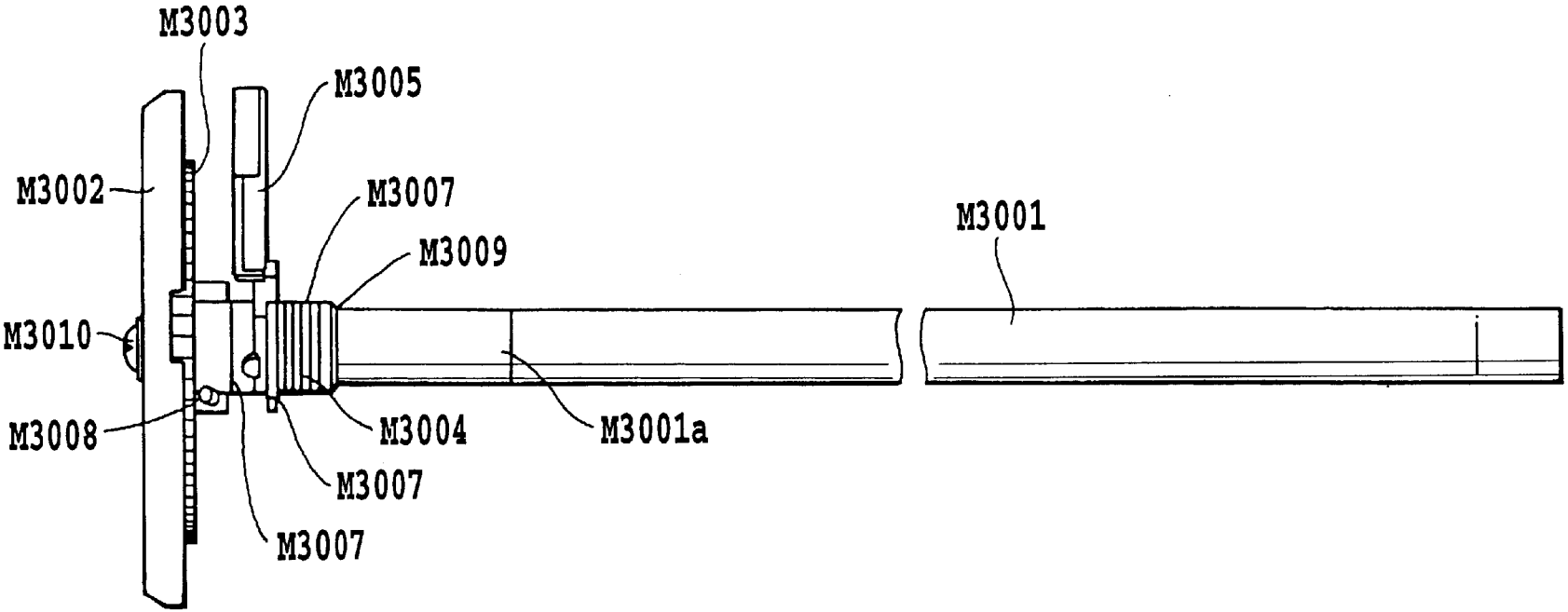
FIG. 4 is a front view showing a feed roller and an LF gear cover shown in FIG. 2.

The paper transport unit M3029 has an LF roller M3001, pinch rollers M3014 and a platen M2001. The LF roller M3001 is secured to a drive shaft rotatably supported on the chassis M3019 and, as shown in FIG. 4, has attached to one end thereof an LF gear cover M3002 that protects both an LF gear M3003 secured to the drive shaft M3001*a* and a small gear M3012*a* (see FIG. 2) of an LF intermediate gear M3012 in mesh with the LF gear M3003. The LF intermediate gear M3012 is interlocked with a drive gear of a drive shaft of an LF motor E0002 described later and is driven by the driving force of the motor.

The pinch rollers M3014 are rotatably mounted at the front end of pinch roller holders M3015 which is pivotally supported on the chassis M3019. The pinch rollers M3014 are pressed against the LF roller M3001 by spiral spring-like pinch roller springs M3016 that bias the pinch roller holders M3015. As a result, the pinch rollers M3014 rotate following the rotation of the LF roller M3001 to feed forwardly the print sheet, which was at rest in a looped state as described above, by gripping it between the pinch rollers M3014 and the LF roller M3001.

Figure 5:
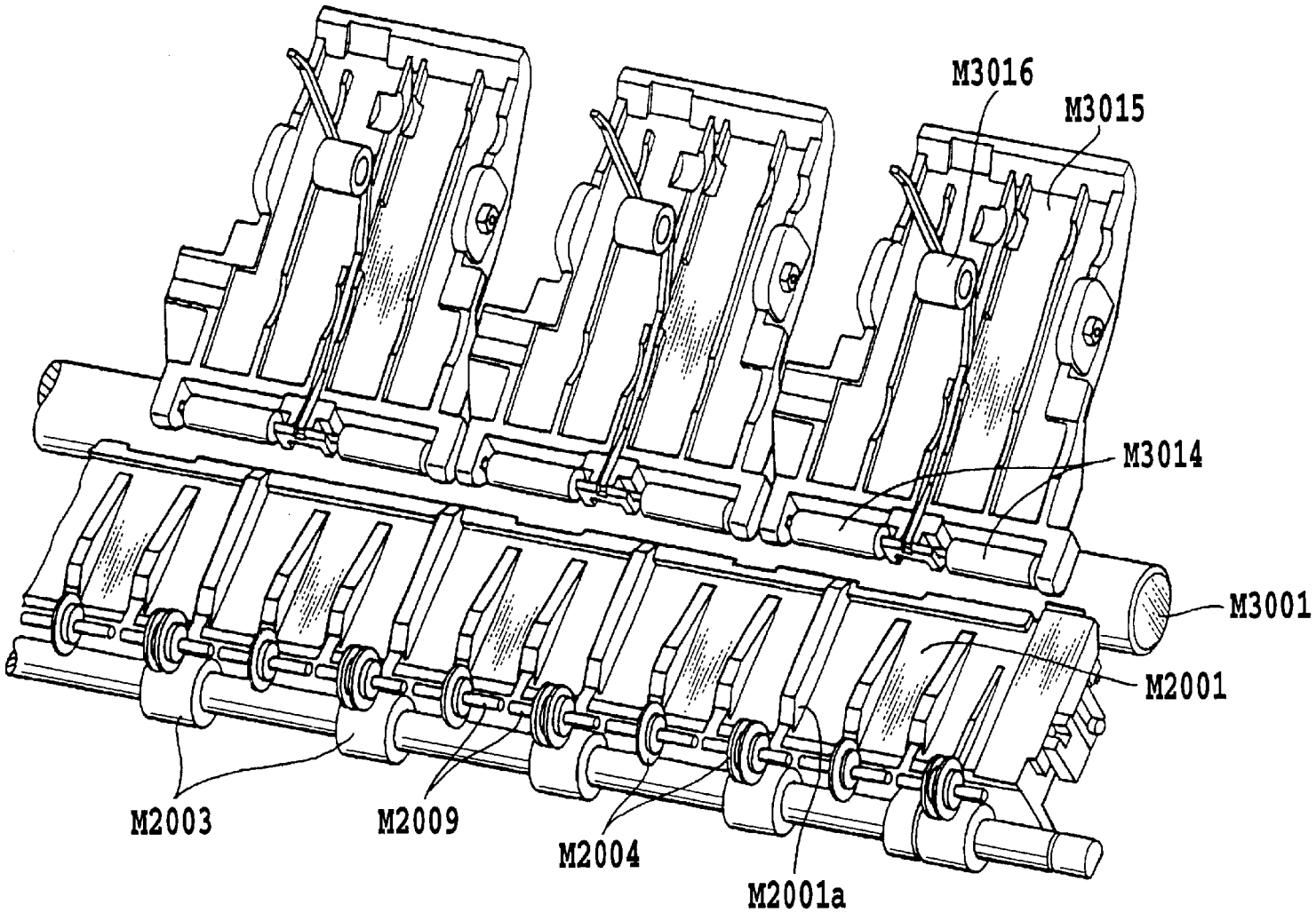
FIG. 5 is a perspective view showing pinch rollers and others shown in FIG. 2.

The rotation center of the pinch rollers M3014 is offset about 2 mm downstream of the rotation center of the LF roller M3001 in the direction of transport. Hence, the print sheet fed by the LF roller M3001 and the pinch rollers M3014 advances toward lower right in FIG. 3 along a print sheet support surface M2001*a* (FIG. 5).

A predetermined time after the feeding operation by the feed rollers M3026 of the automatic sheet feed unit M3022 has stopped, the paper transport unit constructed as described above starts the LF motor E0002. The driving force of the LF motor E0002 is transmitted via the LF intermediate gear M3012 and the LF gear M3003 to the LF roller M3001. As the LF roller M3001 rotates, the print sheet whose front end is in contact with the nip portion between the LF roller M3001 and the pinch rollers M3014 is carried to the print start position on the platen M2001.

At this time, the feed rollers M3026 resume rotating simultaneously with the LF roller M3001, so that the print sheet is transported downstream by the cooperation of the feed rollers M3026 and the LF roller M3001 for a predetermined period of time. A print head cartridge H1000 described later moves, mounted on a carriage M4001, along a carriage shaft M4012 secured at its ends to the chassis M3019, the carriage M4001 being adapted to reciprocate in a direction (scan direction) perpendicular to the direction in which the print sheet is fed. As it travels in the scan direction, the print head cartridge H1000 ejects ink, according to an image information, onto the print sheet held at the print start position to form an image.

After the image has been printed, the LF roller M3001 is rotated to feed the print sheet a predetermined distance at a time, which may correspond to one line height of, for example, 5.42 mm, followed by the carriage M4001 performing the main scan along the carriage shaft M4012. This process is repeated to complete an entire image on the print sheet placed on the platen M2001.

The carriage shaft M4012 has its one end mounted on an adjust plate (not shown) through an adjust lever 2015 and the other end mounted on another adjust plate M2012 through a carriage shaft cam M2011. The carriage shaft M4012 is biased by a carriage shaft spring M2014. The adjust plate M2012 and the other adjust plate not shown are secured to the chassis M3019 so that the distance between the ejecting face of the print head cartridge H1000 and the print sheet support surface M2001*a* of the platen M2001 can be adjusted to be an appropriate value.

Further, the adjust lever 2015 can be selectively set at one of two stop positions, an upper end position shown in FIG. 1 and a lower end position not shown. When the adjust lever 2015 is moved to the lower end position, the carriage M4001 is retracted about 0.6 mm from the platen M2001. Hence, if the print sheet is thick, as when an envelope is printed, the adjust lever 2015 is moved to the lower end position before the sheet feeding operation by the automatic sheet feed unit M3022 is started.

Figure 14:
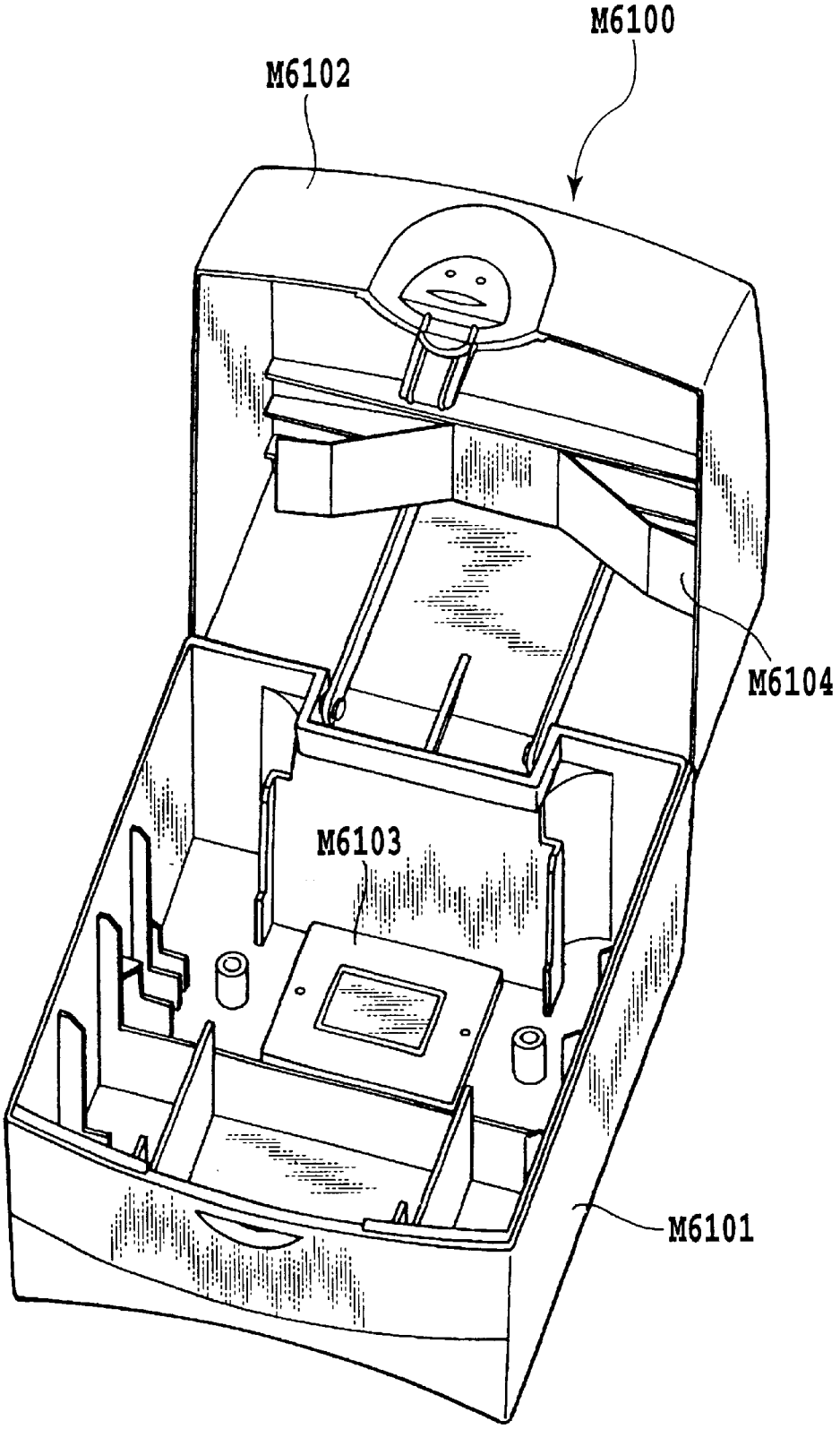
FIG. 14 is a perspective view showing a storage case in the embodiment of the invention.

When the adjust lever 2015 is located at the lower end position, this state is detected by the GAP sensor E0008 (see FIG. 14). Therefore, when the print sheet begins to be fed by the automatic sheet feed unit M3022, it is checked whether the position setting of the adjust lever 2015 is appropriate or not. When an inappropriate state is detected, a warning is issued by displaying a message or activating a buzzer to prevent the printing operation from being executed in an inappropriate condition.

I.3 Discharge Unit

Next, the discharge unit M3030 will be described by referring to FIGS. 2 and 3.

As shown in FIG. 3, the discharge unit M3030 has a discharge roller 2003; a discharge gear M3013 mounted on the discharge roller 2003 to transmit the driving force of the LF motor E0002 through the LF intermediate gear M3012 to the discharge roller 2003; a first spur M2004 rotated by the rotation of the discharge roller 2003 to grip the print sheet between it and the discharge roller 2003 to feed the sheet, and a discharge tray M1004 to aid in the discharge of the print sheet. The first spur M2004 is pressed against the discharge roller 2003 by a biasing force of a spur spring M2009 attached to a first spur holder M2006 mounted on a spur stay M2007.

The print sheet carried to the discharge unit M3030 is subjected to the transport force from the discharge roller 2003 and the first spur M2004. The rotation center of the first spur M2004 is offset about 2 mm upstream, in the transport direction, of the rotation center of the discharge roller 2003. Hence, the print sheet moved by the discharge roller 2003 and the first spur M2004 comes into light contact with the print sheet support surface M2001*a* of the platen M2001 with no gap between them and is therefore transported properly and smoothly.

The speed of the print sheet carried by the discharge roller 2003 and the first spur M2004 is almost equal to the speed of the sheet fed by the LF roller M3001 and the pinch roller M3014. To effectively prevent the print sheet from becoming slack, the speed at which the sheet is moved by the discharge roller 2003 and the first spur M2004 is set slightly higher.

Further, a second spur M2005 accommodated in a second spur holder M2008 is held on a part of the spur stay M2007 downstream of the first spur M2004 to prevent the print sheet from coming into a frictional, sliding contact with the spur stay M2007.

When the printing of an image on the print sheet is finished and the rear end of the print sheet comes off from between the LF roller M3001 and the pinch roller M3014, the print sheet is moved only by the discharge roller 2003 and the first spur M2004 until it is completely discharged.

I.4 Print Unit

Here, the print unit M4000 will be described. The print unit M4000 comprises a carriage M4001 movably supported on a carriage shaft M4021 and a print head cartridge H1000 removably mounted on the carriage M4001.

I.4.1 Print Head Cartridge

Figure 6:
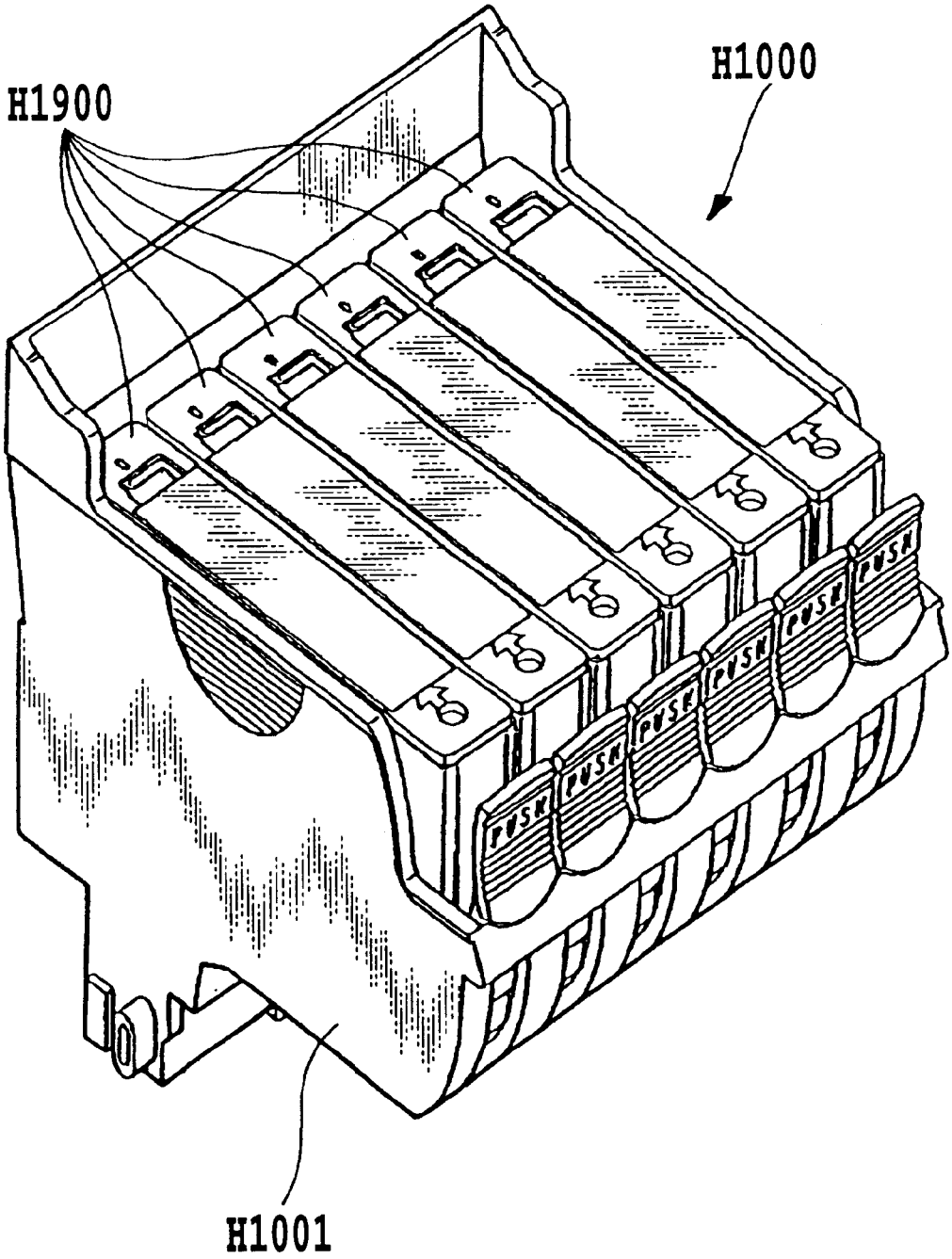
FIG. 6 is a perspective view showing an assembled print head cartridge used in the printer of one embodiment of the present invention.
Figure 7:
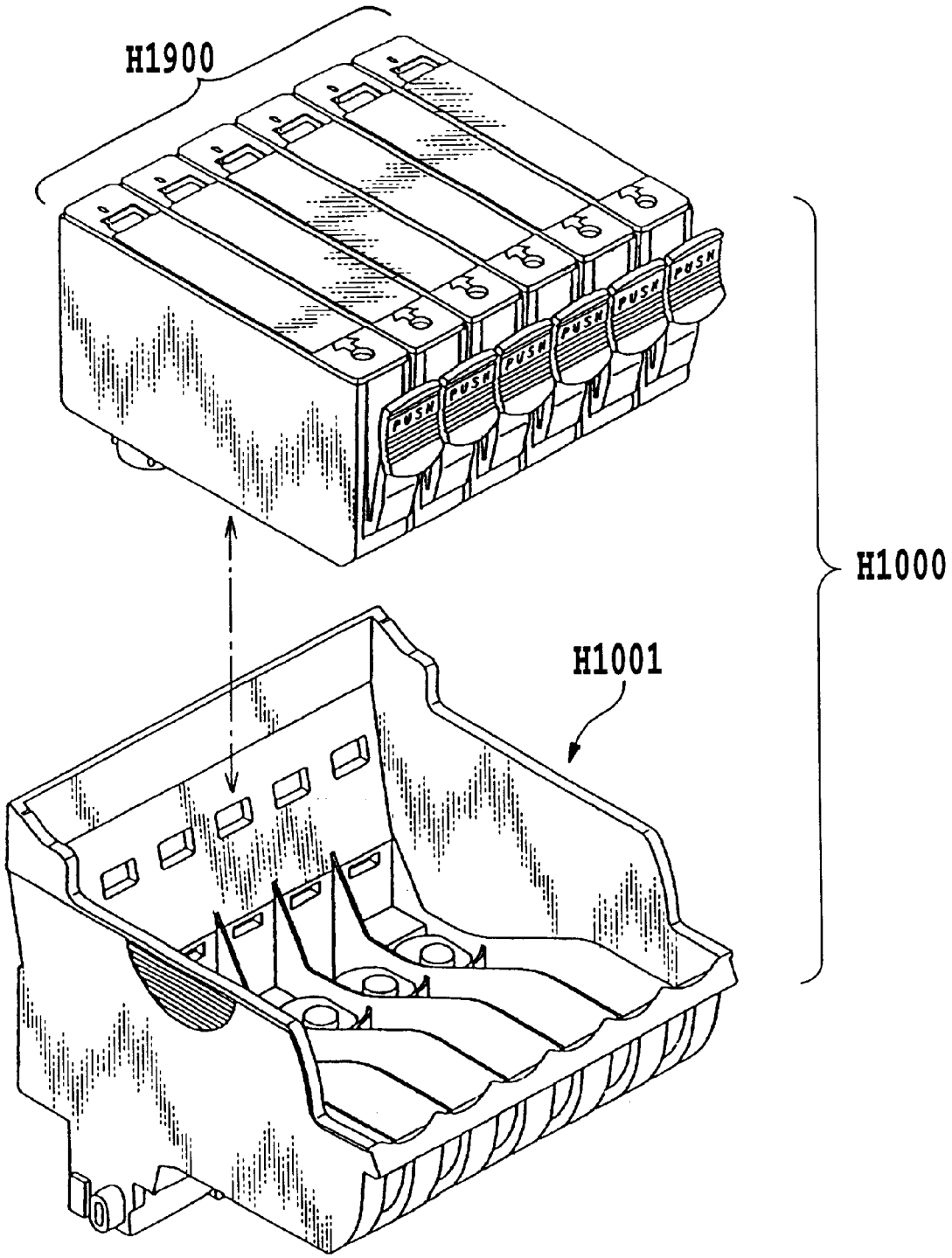
FIG. 7 is an exploded perspective view showing the print head cartridge of FIG. 6.
Figure 8:
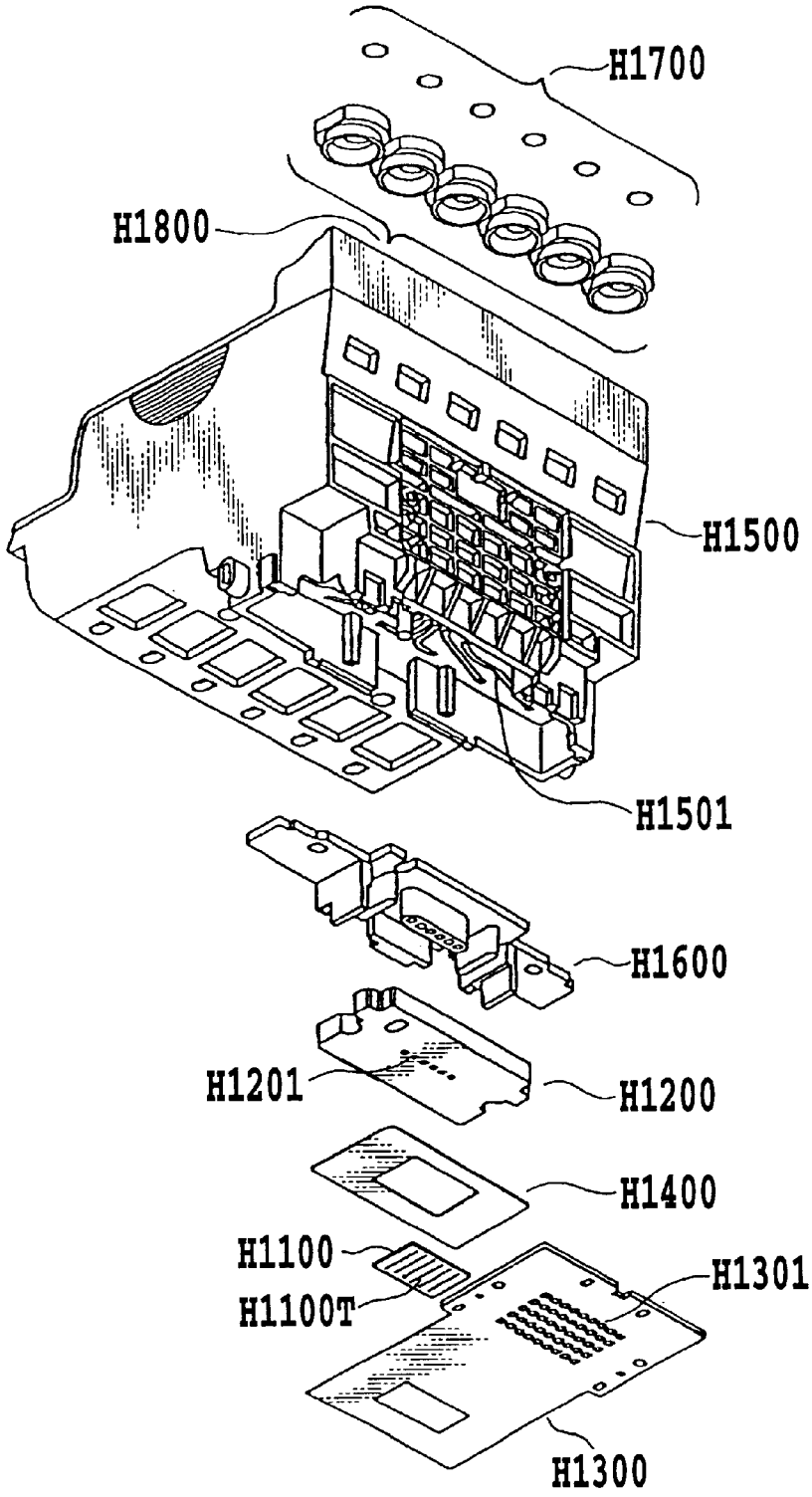
FIG. 8 is an exploded perspective view of the print head of FIG. 7 as seen from diagonally below.

First, the print head cartridge used in the print unit will be described with reference to FIGS. 6 to 8.

The print head cartridge H1000 in this embodiment, as shown in FIG. 3, has an ink tank H1900 containing inks and a print head H1001 for ejecting ink supplied from the ink tank H1900 out through nozzles according to print information. The print head H1001 is of a so-called cartridge type in which it is removably mounted to the carriage M4001 described later.

The ink tank for this print head cartridge H1000 consists of separate ink tanks H1900 of, for example, black, light cyan, light magenta, cyan, magenta and yellow to enable color printing with as high an image quality as photograph. As shown in FIG. 4, these individual ink tanks are removably mounted to the print head H1001.

Then, the print head H1001, as shown in the perspective view of FIG. 5, comprises a print element substrate H1100, a first plate H1200, an electric wiring board H1300, a second plate H1400, a tank holder H1500, a flow passage forming member H1600, a filter H1700 and a seal rubber H1800.

The print element silicon substrate H1100 has formed in one of its surfaces, by the film deposition technology, a plurality of print elements to produce energy for ejecting ink and electric wires, such as aluminum, for supplying electricity to individual print elements. A plurality of ink passages and a plurality of nozzles H1100T, both corresponding to the print elements, are also formed by the photolithography technology. In the back of the print element substrate H1100, there are formed ink supply ports for supplying ink to the plurality of ink passages. The print element substrate H1100 is securely bonded to the first plate H1200 which is formed with ink supply ports H1201 for supplying ink to the print element substrate H1100. The first plate H1200 is securely bonded with the second plate H1400 having an opening. The second plate H1400 holds the electric wiring board H1300 to electrically connect the electric wiring board H1300 with the print element substrate H1100. The electric wiring board H1300 is to apply electric signals for ejecting ink to the print element substrate H1100, and has electric wires associated with the print element substrate H1100 and external signal input terminals H1301 situated at electric wires' ends for receiving electric signals from the printer body. The external signal input terminals H1301 are positioned and fixed at the back of a tank holder H1500 described later.

The tank holder H1500 that removably holds the ink tank H1900 is securely attached, as by ultrasonic fusing, with the flow passage forming member H1600 to form an ink passage H1501 from the ink tank H1900 to the first plate H1200. At the ink tank side end of the ink passage H1501 that engages with the ink tank H1900, a filter H1700 is provided to prevent external dust from entering. A seal rubber H1800 is provided at a portion where the filter H1700 engages the ink tank H1900, to prevent evaporation of the ink from the engagement portion.

As described above, the tank holder unit, which includes the tank holder H1500, the flow passage forming member H1600, the filter H1700 and the seal rubber H1800, and the print element unit, which includes the print element substrate H1100, the first plate H1200, the electric wiring board H1300 and the second plate H1400, are combined as by adhesives to form the print head H1001.

I.4.2 Carriage

Figure 9:
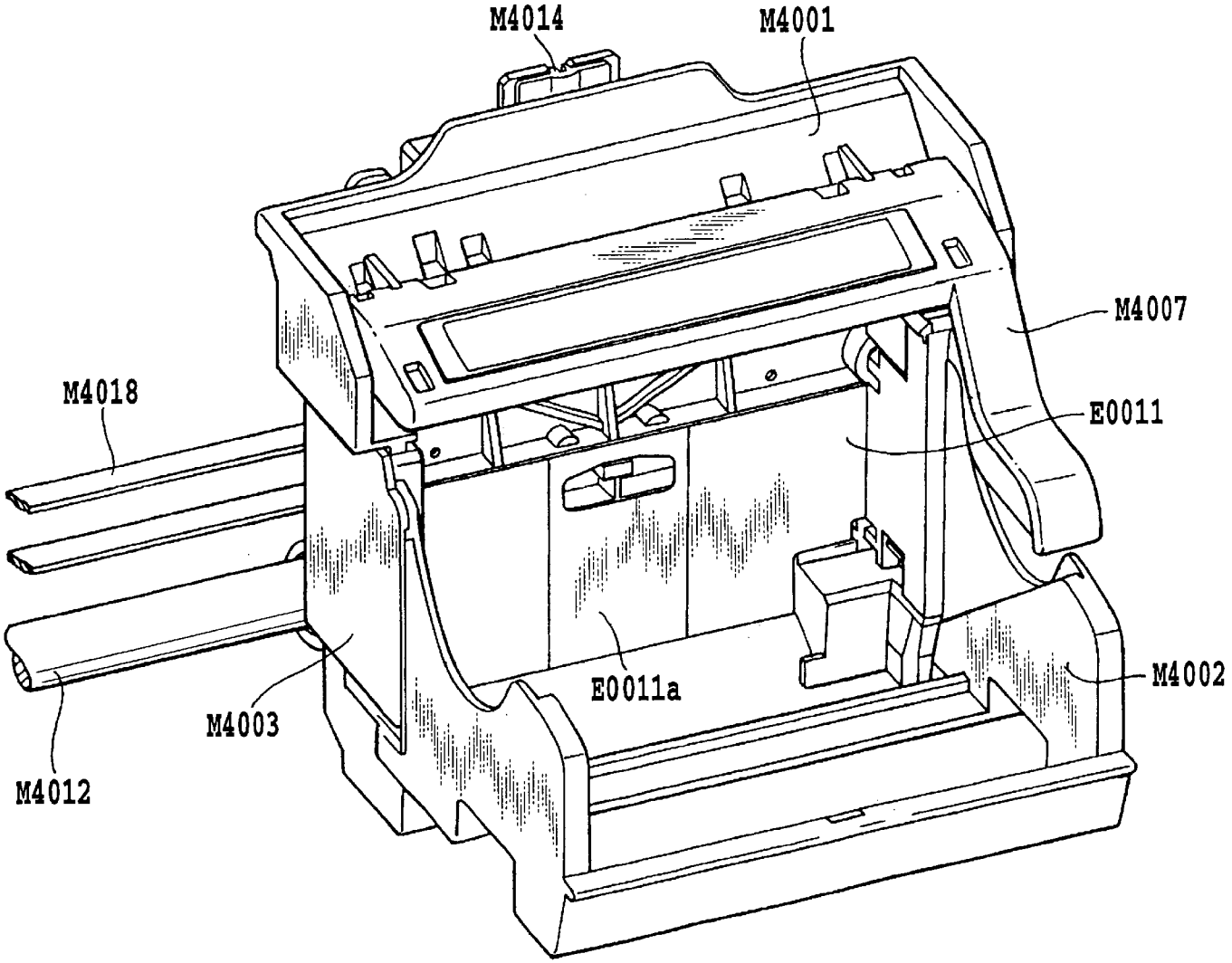
FIG. 9 is a perspective view showing the front side of a carriage used in the embodiment of the invention.

Next, by referring to FIGS. 2, 9 and 10, the carriage M4001 carrying the print head cartridge H1000 will be explained.

As shown in FIG. 2, the carriage M4001 has a carriage cover M4002 for guiding the print head H1001 to a predetermined mounting position on the carriage M4001, and a head set lever M4007 that engages and presses against the tank holder H1500 of the print head H1001 to set the print head H1001 at a predetermined mounting position.

That is, the head set lever M4007 is provided at the upper part of the carriage M4001 so as to be pivotable about a head set lever shaft M4008. There is a spring-loaded head set plate (not shown) at an engagement portion where the carriage M4001 engages the print head H1001. With the spring force, the head set lever M4007 presses against the print head H1001 to mount it on the carriage M4001.

At another engagement portion of the carriage M4001 with the print head H1001, there is provided a contact flexible printed cable (simply referred to as a contact FPC hereinafter) E0011 whose contact unit E0011*a* electrically contacts a contact portion (external signal input terminals) H1301 provided in the print head H1001 to transfer various information for printing and supply electricity to the print head H1001.

An elastic member such as rubber not shown is provided between a contact unit E0011*a* of a contact FPC E0011 and the carriage M4001. The elastic force of the elastic member and the pressing force of the head set lever spring combine to ensure a reliable contact between the contact unit E0011*a* and the carriage M4001. The contact FPC E0011 is drawn to the sides of the carriage M4001 and, as shown in FIGS. 9 and 10, has its end portions securely held to the sides of the carriage M4001 by a pair of FPC retainers M4003, M4006. The contact FPC E0011 is connected to a carriage printed circuit board E0013 mounted on the back of the carriage M4001 (see FIG. 10).

Figure 10:
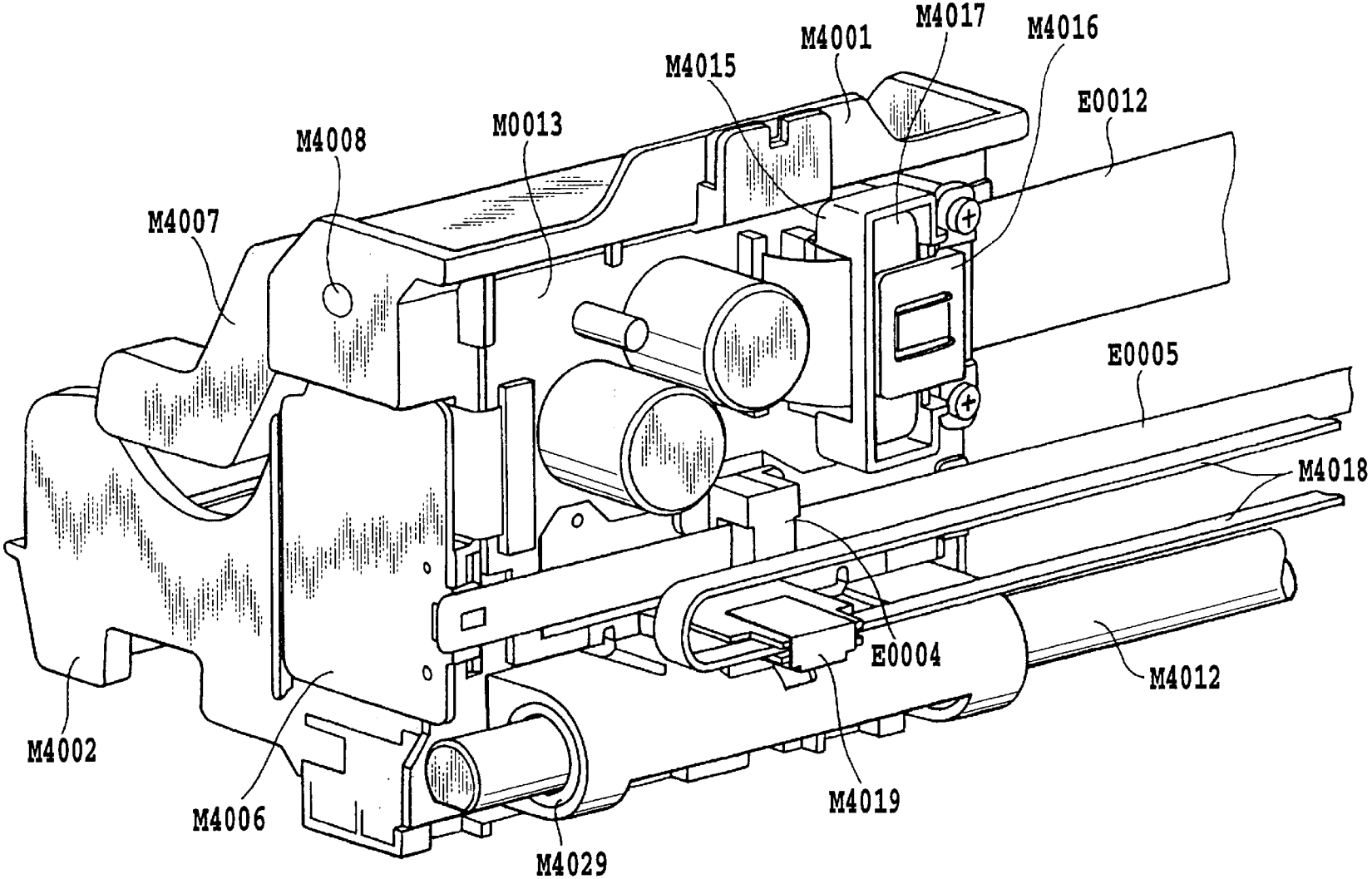
FIG. 10 is a perspective view showing the back side of the carriage of FIG. 9.

As shown in FIG. 10, the carriage printed circuit board E0013 is electrically connected through a carriage flexible flat cable (carriage FFC) E0012 to a main printed circuit board E0014 mounted on the chassis M3019 (see FIG. 15), which will be described later. Further, as shown in FIG. 10, at a joint portion between one end of the carriage FFC E0012 and the carriage printed circuit board E0013 a pair of retainer members, flexible flat cable retainers (FCC retainers) M4015, M4016, are provided to fixedly secure the carriage FFC E0012 to the carriage printed circuit board E0013 (see FIG. 15). Also installed at the joint portion is a ferrite core M4017 that shields electromagnetic radiations emitted from the carriage FFC E0012 and others.

The other end of the carriage FFC E0012 is fixed to the chassis M3019 (FIG. 2) by an FFC retainer M4028 (FIG. 2) and then drawn out to the rear side of the chassis M3019 through a hole not shown in the chassis M3019 and connected to the main printed circuit board E0014 (FIG. 15).

As shown in FIG. 10, the carriage printed circuit board E0013 has an encoder sensor E0004, which detects information from an encoder scale E0005 extending parallel to the carriage shaft M4012 between the both sides of the chassis M3019 to detect the position and scan speed of the carriage M4001. In this embodiment, the encoder sensor E0004 is of an optical transmission type. The encoder scale E0005 is a resin film, such as polyester film, which is printed, by the photographic plate making technique, alternately at a predetermined pitch with light shielding portions for shielding detection light emitted from the encoder sensor and light transmitting portions for transmitting the detection light.

Therefore, the position of the carriage M4001 moving along the carriage shaft M4012 can be detected at any time by first putting the carriage M4001 against one side plate of the chassis M3019 provided at an end of the scanning track of the carriage M4001, taking this position as a reference position, and counting the number of patterns formed on the encoder scale E0005 by the encoder sensor E0004 as the carriage M4001 performs scanning.

The carriage M4001 is guided for scan operation along the carriage shaft M4012 and the carriage rail M4013 extending between the both sides of the chassis M3019. At bearing portions for the carriage shaft M4012, the carriage M4001 has integrally formed therewith as by an insert molding a pair of carriage shaft bearings M4029 made of a sintered metal impregnated with lubricant such as oil. Further, at a portion engaging with the carriage rail M4013, the carriage M4001 has a carriage slider (CR slider) M4014 made of resin with excellent sliding performance and wear resistance. Along with the carriage shaft bearings M4029, the CR slider M4014 enables a smooth scanning motion of the carriage M4001.

The carriage M4001 is secured to a carriage belt M4018 that extends almost parallel to the carriage shaft between an idler pulley M4020 (FIG. 2) and a carriage motor pulley M4024 (FIG. 2). The carriage motor E0001 (FIG. 14) drives the carriage motor pulley M4024 to move the carriage belt M4018 in the forward or backward direction and thereby scan the carriage M4001 along the carriage shaft M4012. The carriage motor pulley M4024 is held at a fixed position by the chassis, whereas the idler pulley M4020 together with a pulley holder M4021 is held movable relative to the chassis M3019. Because the idler pulley M4020 is urged away from the carriage motor pulley M4024 by a spring, the carriage belt M4018 wound around the both pulleys M4020 and M4024 is given an appropriate tension at all times and thus kept in good state with no slack.

At the connecting portion between the carriage belt M4018 and the carriage M4001 is provided a carriage belt holder M4019 that ensures a secure holding of the carriage M4001 to the belt.

On the spur stay M2007 in the scanning track of the carriage M4001 an ink empty sensor E0006 (FIG. 2) is exposed facing an ink tank H1900 to measure the remaining amount of ink contained in the ink tank H1900 of the print head cartridge H1000 mounted on the carriage M4001. The ink empty sensor E0006 is held by an ink empty sensor holder M4026 and accommodated in an ink empty sensor cover M4027 having a metal plate to shield noise from outside, thus preventing erroneous operations of the sensor.

I.5 Ejection Performance Recovery Unit

Next, by referring to FIGS. 11 and 12, an ejection performance recovery unit that recovers the ejection performance of the print head cartridge H1000 will be described.

The ejection performance recovery unit 5000 in this embodiment can be mounted to and dismounted from the printer body M1000. The ejection performance recovery unit M5000 has a cleaning means to remove foreign matters adhering to a print element substrate H1100 of the print head H1001 and a recovery means to reinstate the normal condition of the ink path from the ink tank H1900 to the print element substrate H1100 of the print head H1001 (flow path from the portions H1501 to H1400 via H1600).

Figure 11:
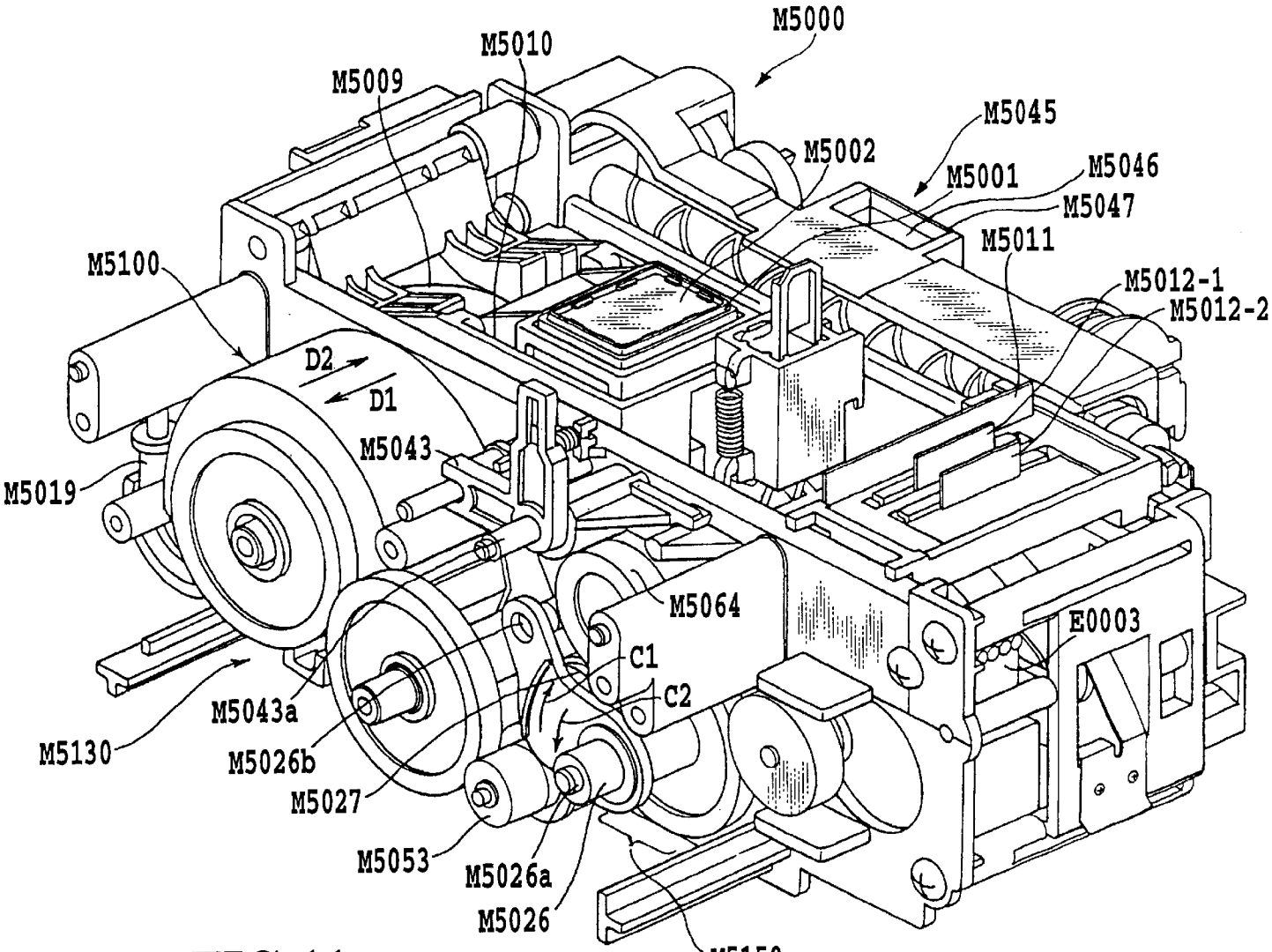
FIG. 11 is a perspective view showing one side of an ejection performance recovery unit in the embodiment of the invention.
Figure 12:
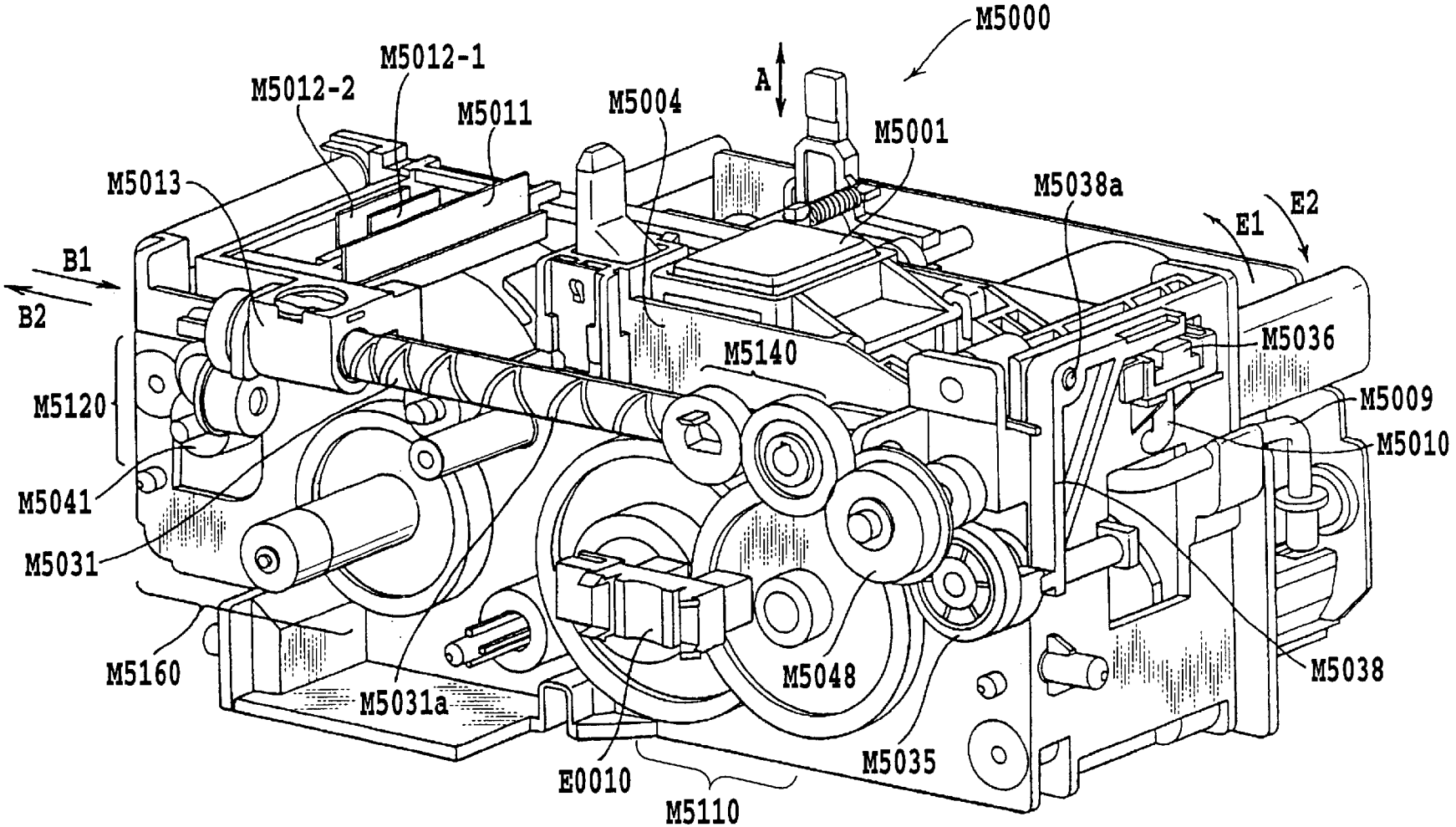
FIG. 12 is a perspective view showing the other side of the ejection performance recovery unit of FIG. 11.

In FIGS. 11 and 12, denoted E0003 is a PG motor which drives a cap M5001 to be described later, a pump M5100, wiper blades M5011, M5012-1, M5012-2 and the automatic sheet feedunit M3022. The driving force is extracted from both sides of the motor shaft of the PG motor E0003. The driving force extracted from one side is transmitted to the pump M5100 or the automatic sheet feed unit M3022 through a drive path switching means described later. The driving force extracted from the other side is transmitted to the cap M5001 and the wiper blades M5011, M5012-1, M5012-2 through a one-way clutch M5041 that engages when the PG motor E0003 rotates only in a particular direction (this rotation direction is referred to as a forward direction and the opposite direction as a reverse direction). Hence, when the PG motor E0003 is rotating in the reverse direction, the one-way clutch M5041 disengages blocking the driving force from being transmitted, so that the cap M5001 and the wiper blades M5011, M5012-1, M5012-2 are not operated.

The cap M5001 is made of an elastic member such as rubber and mounted on a cap lever M5004 that can be pivoted about its axis. The cap M5001 is moved in the direction of arrow A (FIG. 12) through the one-way clutch M5041, a cap drive transmission gear train M5110, a cap cam and the cap lever M5004 so that it can be brought into and out of contact with the print element substrate H1100 of the print head H1001. In the cap M5001 there is provided an absorbing member M5002 which is arranged to oppose the print element substrate H1100 with a predetermined gap therebetween during a capping operation.

The absorbing member M5002 disposed in this way can accept ink drawn out from the print head cartridge H1000 during the suction operation. Further, the ink in the cap M5001 can be discharged out into a used ink absorbing member completely by an evacuation operation described later. The cap M5001 is connected with two tubes, a cap tube M5009 and a valve tube M5010. The cap tube M5009 is connected to a pump tube M5019 of a pump M5100 described later and the valve tube M5010 to a valve rubber M5036 described later.

The wiper blades M5011, M5012-1, M5012-2 are made of elastic members such as rubber and are erected on a blade holder M5013 so that their edges project upward. The blade holder M5013 has a lead screw M5031 inserted therethrough with a projection not shown of the blade holder M5013 movably engaging in a groove formed in the lead screw M5031. As the lead screw M5031 rotates, the blade holder M5013 moves back and forth along the lead screw M5031 in the direction of arrow B1 or B2 (FIG. 12), causing the wiper blades M5011, M5012-1, M5012-2 to wipe clean the print element substrate H1100 of the print head cartridge H1000. The lead screw M5031 is connected to one side of the PG motor E0003 through the one-way clutch M5041 and a wiper drive transmission gear train M5120.

Designated M5100 is a pump that produces a pressure by pressing a roller (not shown) against and moving it along the pump tube M5019. This pump is connected to the other side of the PG motor E0003 via a drive path switching means and the pump drive transmission gear train M5130. The drive path switching means switches the driving force transmission path between the automatic sheet feed unit M3022 and the pump M5100. Although details are not provided, the pump M5100 has a mechanism to release the pressing force with which the roller (not shown) is pressed against the pump tube M5019 to squeeze it. When the PG motor E0003 rotates in the forward direction, the mechanism releases the pressing force from the roller, leaving the tube intact. When the PG motor E0003 rotates in the reverse direction, the mechanism applies the pressing force to the roller to squeeze the tube. One end of the pump tube M5019 is connected to the cap M5001 through the cap tube M5009.

The drive path switching means has a pendulum arm M5026 and a selector lever M5043. The pendulum arm M5026 is pivotable about a shaft M5026*a* in the direction of arrow C1 or C2 (FIG. 11) depending on the rotation direction of the PG motor E0003. The selector lever M5043 is switched according to the position of the carriage M4001. That is, when the carriage moves M4001 to a position over the ejection performance recovery unit M5000, a part of the selector lever M5043 is contacted by a part of the carriage M4001 and moved in the direction of arrow D1 or D2 (FIG. 11) depending on the position of the carriage M4001, with the result that a lock hole M5026*b* of the pendulum arm M5026 and a lock pin M5043*a* of the selector lever M5043 engage.

The valve rubber M5036 is connected with one end of the valve tube M5010 the other end of which is connected to the cap M5001. A valve lever M5038 is connected to the discharge roller 2003 (FIG. 5) through a valve cam M5035, a valve clutch M5048 and a valve drive transmission gear train M5140. As the discharge roller 2003 rotates, the valve lever M5038 is pivoted about a shaft M5038*a* in the direction of arrow E1 or E2 to come into or out of contact with the valve rubber M5036. When the valve lever M5038 is in contact with the valve rubber M5036, the valve is closed. When the lever is parted, the valve is open.

Denoted E0010 is a PG sensor that detects the position of the cap M5001.

Next, the operations of the ejection performance recovery unit M5000 of the above construction will be explained.

First, let us explain about the driving operation of the automatic sheet feed unit M3022.

When, with the carriage M4001 at the retracted position where it does not contact the selector lever M5043, the PG motor E0003 rotates in the reverse direction, the pendulum arm M5026 is pivoted in the direction of arrow C1 (FIG. 11) through a pendulum drive transmission gear train M5150, causing a selector output gear M5027 mounted on the pendulum arm M5026 to mesh with an ASF gear M5064 at one end of an ASF drive transmission gear train M5160. When in this state the PG motor E0003 continues to rotate in the reverse direction, the automatic sheet feed unit M3022 is driven by the PG motor through the ASF drive transmission gear train M5160. At this time, the driving force is not transmitted to the cap M5001 and the wiper blades M5011, M5012-1, M5012-2 because the one-way clutch M5041 is disengaged. Thus, the wiper blades are not operated.

Next, the suction operation of the pump M5100 will be described.

When, with the carriage M4001 at the retracted position where it does not contact the selector lever M5043, the PG motor E0003 rotates in the forward direction, the pendulum arm M5026 is pivoted in the direction of arrow C2 through the pendulum drive transmission gear train M5150, causing the selector output gear M5027 mounted on the pendulum arm M5026 to mesh with a pump gear M5053 at one end of the pump drive transmission gear train M5130.

Then, when the carriage M4001 moves to the capping position (a carriage position where the print element substrate H1100 of the print head cartridge H1000 faces the cap M5001), a part of the carriage M4001 abuts against a part of the selector lever M5043, which is then moved in the direction of D1, causing the lock pin M5043*a* of the selector lever M5043 to fit into the lock hole M5026*b* of the pendulum arm M5026. As a result, the pendulum arm M5026 is locked connected to the pump side.

Here, the discharge roller 2003 is driven in the reverse direction and the valve lever M5038 is rotated in the direction of arrow E1, opening the valve rubber M5036. In this open state, the PG motor E0003 rotates in the forward direction to drive the cap M5001 and the wiper blades M5011, M5012-1, M5012-2 to perform the capping operation (an operation whereby the cap M5001 hermetically contacts and covers the print element substrate H1100 of the print head H1001). At this time, the pump M5100 is operated but the pressing force of a roller (not shown) against the pump tube M5019 is released, so that the pump tube M5019 is not worked and no pressure is generated.

When the discharge roller 2003 is driven in the forward direction and the valve lever M5038 is pivoted in the direction of arrow E2 (FIG. 12), the valve rubber M5036 is closed. At this time, the PG motor E0003 rotates in the reverse direction to squeeze the pump tube M5019 by the pressing force of the roller to apply a negative pressure to the print element substrate H1100 of the print head cartridge H1000 through the cap tube M5009 and the cap M5001, forcibly drawing out ink and foams not suited for printing from the nozzles in the print element substrate H1100.

After this, the PG motor E0003 rotates in the reverse direction and at the same time the discharge roller 2003 is driven in the reverse direction to pivot the valve lever M5038 in the direction of arrow E1 (FIG. 12). Now the valve rubber M5036 is open. As a result, the pressure in the pump tube M5019, the cap tube M5009 and the cap M5001 is equal to an atmospheric pressure, stopping the forced suction of the ink nozzles in the print element substrate H1100 of the print head cartridge H1000. At the same time, the ink contained in the pump tube M5019, the cap tube M5009 and the cap M5001 is drawn out from the other end of the pump tube M5019 into the used ink absorbing member (not shown). This operation is referred to as an evacuation. Then, the PG motor E0003 is stopped, the discharge roller 2003 is driven in the forward direction and the valve lever M5038 is pivoted in the direction of arrow E2 (FIG. 12), closing the valve rubber M5036. Now the suction operation is finished.

Next, the wiping operation will be explained.

During the wiping operation, the PG motor E0003 is first rotated in the forward direction to move the wiper blades M5011, M5012-1, M5012-2 to the wiping start position (a position where the wiper blades M5011, M5012-1, M5012-2 are upstream of the print head cartridge H1000 in the printing operation, with the cap M5001 separated from the print head cartridge H1000). Next, the carriage M4001 moves to a wiping position where the wiper blades M5011, M5012-1, M5012-2 face the print element substrate H1100. At this time, the carriage M4001 is not in contact with the selector lever M5043 and the pendulum arm M5026 is not in the locked state.

Then, the PG motor E0003 rotates in the forward direction to move the wiper blades M5011, M5012-1, M5012-2 in the direction of arrow B1 (FIG. 12) wiping clean the print element substrate H1100 of the print head cartridge H1000. Further, a wiper blade cleaning means (not shown) provided downstream of the print element substrate H1100 of the print head cartridge H1000 in the direction of the printing operation clears the wiper blades of the adhering ink. At this time, the cap M5001 is kept in the separated state.

When the wiper blades reach the wiping end position (a downstream end position in the printing operation), the PG motor is stopped and the carriage M4001 is moved to the wiping standby position out of the wiping operation range of the wiper blades M5011, M5012-1, M5012-2. Then, the PG motor E0003 is rotated in the forward direction to move the wiper blades to the wiping end position. At this time, too, the cap M5001 is maintained in the separated state. Now, the wiping operation is finished.

Next, the preliminary ejection will be explained.

Performing the suction operation and the wiping operation on a print head that uses a plurality of inks may cause a problem of ink mixing.

For example, during the suction operation, ink drawn out from the nozzles may get into nozzles of other color inks and, during the wiping operation, inks of various colors adhering to the circumferences of the nozzles may be pushed into nozzles of different color inks by the wipers. When the next printing is started, the initial part of the printed image may be discolored (or exhibit mixed colors), degrading the printed image.

To prevent the color mixing, the ink that may have mixed with other color inks is ejected out immediately before printing. This is called a preliminary ejection. In this embodiment, as shown in FIG. 11, a preliminary ejection port M5045 is arranged near the cap M5001. Immediately before printing, the print element substrate H1100 of the print head is moved to a position opposing the preliminary ejection port M5045 where it is subjected to the preliminary ejection operation.

The preliminary ejection port M5045 has a preliminary ejection absorbing member M5046 and a preliminary ejection cover M5047. The preliminary ejection absorbing member M5046 communicates with the used ink absorbing member not shown.

I.6 Scanner

The printer of this embodiment can mount a scanner in the carriage M4001 in place of the print head cartridge H1000 and be used as a reading device.

The scanner moves together with the carriage M4001 in the main scan direction, and reads an image on a document fed instead of the printing medium as the scanner moves in the main scan direction. Alternating the scanner reading operation in the main scan direction and the document feed in the sub-scan direction enables one page of document image information to be read.

Figures 13A, 13B:
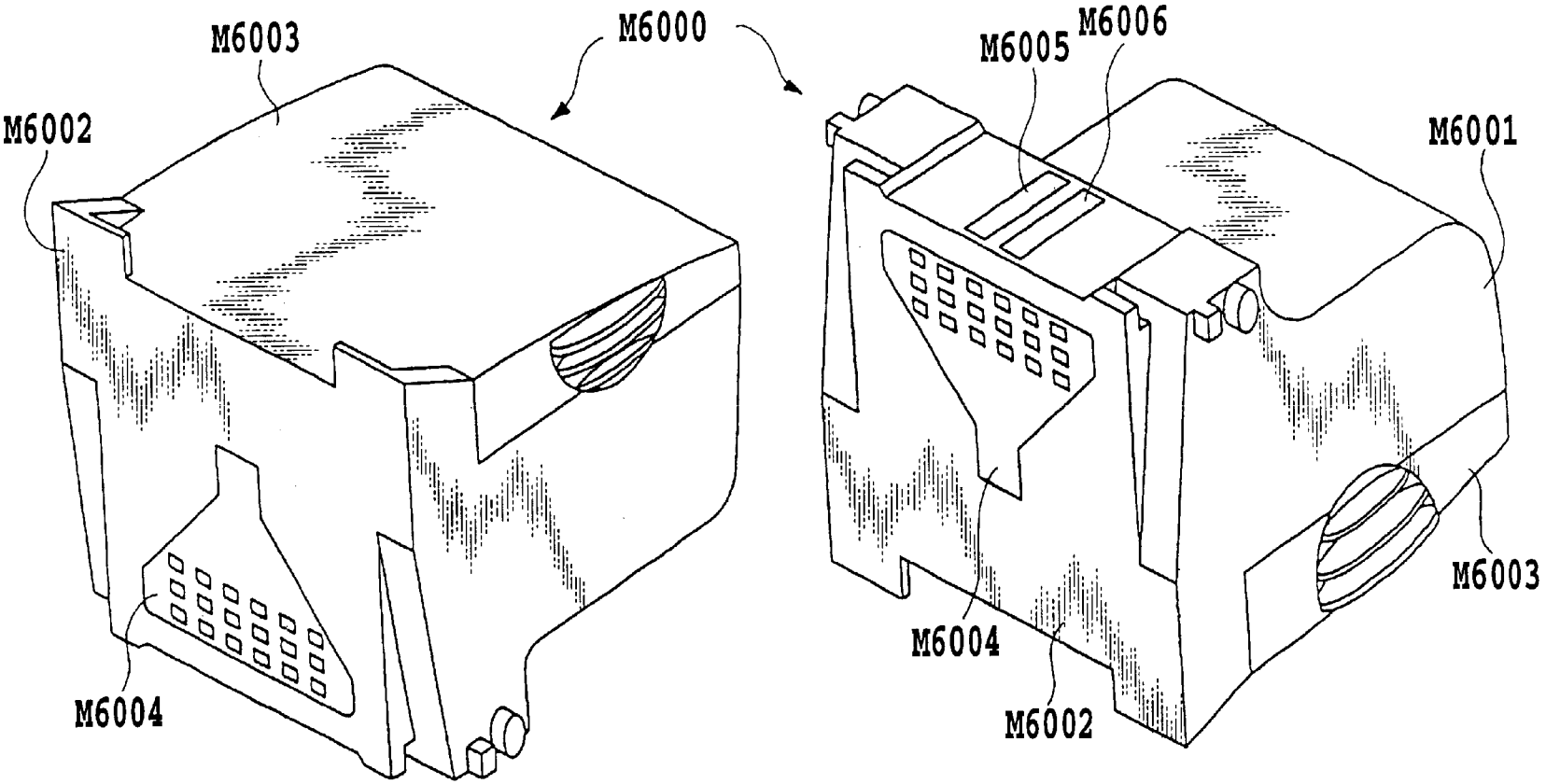
FIGS. 13A and 13B are perspective views showing a construction of a scanner cartridge upside down which can be mounted in the printer of one embodiment of the present invention instead of the print head cartridge of FIG. 6.

FIGS. 13A and 13B show the scanner M6000 upside down to explain about its outline construction.

As shown in the figure, a scanner holder M6001 is shaped like a box and contains an optical system and a processing circuit necessary for reading. A reading lens M6006 is provided at a portion that faces the surface of a document when the scanner M6000 is mounted on the carriage M4001. The lens M6006 focuses light reflected from the document surface onto a reading unit inside the scanner to read the document image. An illumination lens M6005 has a light source not shown inside the scanner. The light emitted from the light source is radiated onto the document through the lens M6005.

The scanner cover M6003 secured to the bottom of the scanner holder M6001 shields the interior of the scanner holder M6001 from light. Louver-like grip portions are provided at the sides to improve the ease with which the scanner can be mounted to and dismounted from the carriage M4001. The external shape of the scanner holder M6001 is almost similar to that of the print head H1001, and the scanner can be mounted to or dismounted from the carriage M4001 in a manner similar to that of the print head H1001.

The scanner holder M6001 accommodates a substrate having a reading circuit, and a scanner contact PCB M6004 connected to this substrate is exposed outside. When the scanner M6000 is mounted on the carriage M4001, the scanner contact PCB M6004 contacts the contact FPC E0011 of the carriage M4001 to electrically connect the substrate to a control system on the printer body side through the carriage M4001.

I.7 Storage Box

FIG. 14 shows a storage box M6100 for storing the print head H1001.

The storage box M6100 comprises a storage box base M6101 having an opening at its top, a storage box cover M6102 pivotally mounted on the storage box base M6101 to open and close the opening, a storage box cap M6103 secured to the bottom of the storage box base M6101, and a leaf spring-like storage box spring M6104 secured to the inner top portion of the storage box cover M6102.

When the print head is to be stored in the storage box of the above construction, the print head is inserted into the storage box base M6101 so that the nozzle portion faces the storage box cap and then the storage box cover M6102 is closed to engage a locking portion of the storage box base M6101 with the storage box cover M6102 to keep the storage box cover M6102 in a closed state. Because the storage box spring M6104 in this closed state applies a pressing force to the print head H1001, the nozzle portion of the print head H1001 is hermetically covered by the storage box cap M6103. Therefore, this storage box can protect the print head nozzles against dust and ink evaporation and therefore maintain the print head in good condition for a long period of time.

The storage box M6100 for storing the print head H1001 can also be used for storing the scanner M6000. It is noted, however, that because the storage box cap M6103 that protects the nozzle portion of the print head H1001 is smeared with ink, it is strongly suggested that to prevent the ink from adhering to the scanner, the scanner be stored so that the scanner surface on which the scanner reading lens M6006 and the scanner illumination lens M6005 are arranged is directed away from the storage box cap M6103.

I.8 Example Configuration of Printer Electric Circuit

Next, an electric circuit configuration in this embodiment of the invention will be explained.

FIG. 15 schematically shows the overall configuration of the electric circuit in this embodiment.

The electric circuit in this embodiment comprises mainly a carriage substrate (CRPCB) E0013, a main PCB (printed circuit board) E0014 and a power supply unit E0015.

The power supply unit E0015 is connected to the main PCB E0014 to supply a variety of drive power.

The carriage substrate E0013 is a printed circuit board unit mounted on the carriage M4001 (FIG. 2) and functions as an interface for transferring signals to and from the print head through the contact FPC E0011. In addition, based on a pulse signal output from an encoder sensor E0004 as the carriage M4001 moves, the carriage substrate E0013 detects a change in the positional relation between an encoder scale E0005 and the encoder sensor E0004 and sends its output signal to the main PCB E0014 through a flexible flat cable (CRFFC) E0012.

Further, the main PCB E0014 is a printed circuit board unit that controls the operation of various parts of the ink jet printing apparatus in this embodiment, and has I/O ports for a paper end sensor (PE sensor) E0007, an automatic sheet feeder (ASF) sensor E0009, a cover sensor E0022, a parallel interface (parallel I/F) E0016, a serial interface (Serial I/F) E0017, a resume key E0019, an LED E0020, a power key E0018 and a buzzer E0021. The main PCB E0014 is connected to and controls a motor (CR motor) E0001 that constitutes a drive source for moving the carriage M4001 in the main scan direction; a motor (LF motor) E0002 that constitutes a drive source for transporting the printing medium; and a motor (PG motor) E0003 that performs the functions of recovering the ejection performance of the print head and feeding the printing medium. The main PCB E0014 also has connection interfaces with an ink empty sensor E0006, a gap sensor E0008, a PG sensor E0010, the CRFFC E0012 and the power supply unit E0015.

Figures 16, 16A:
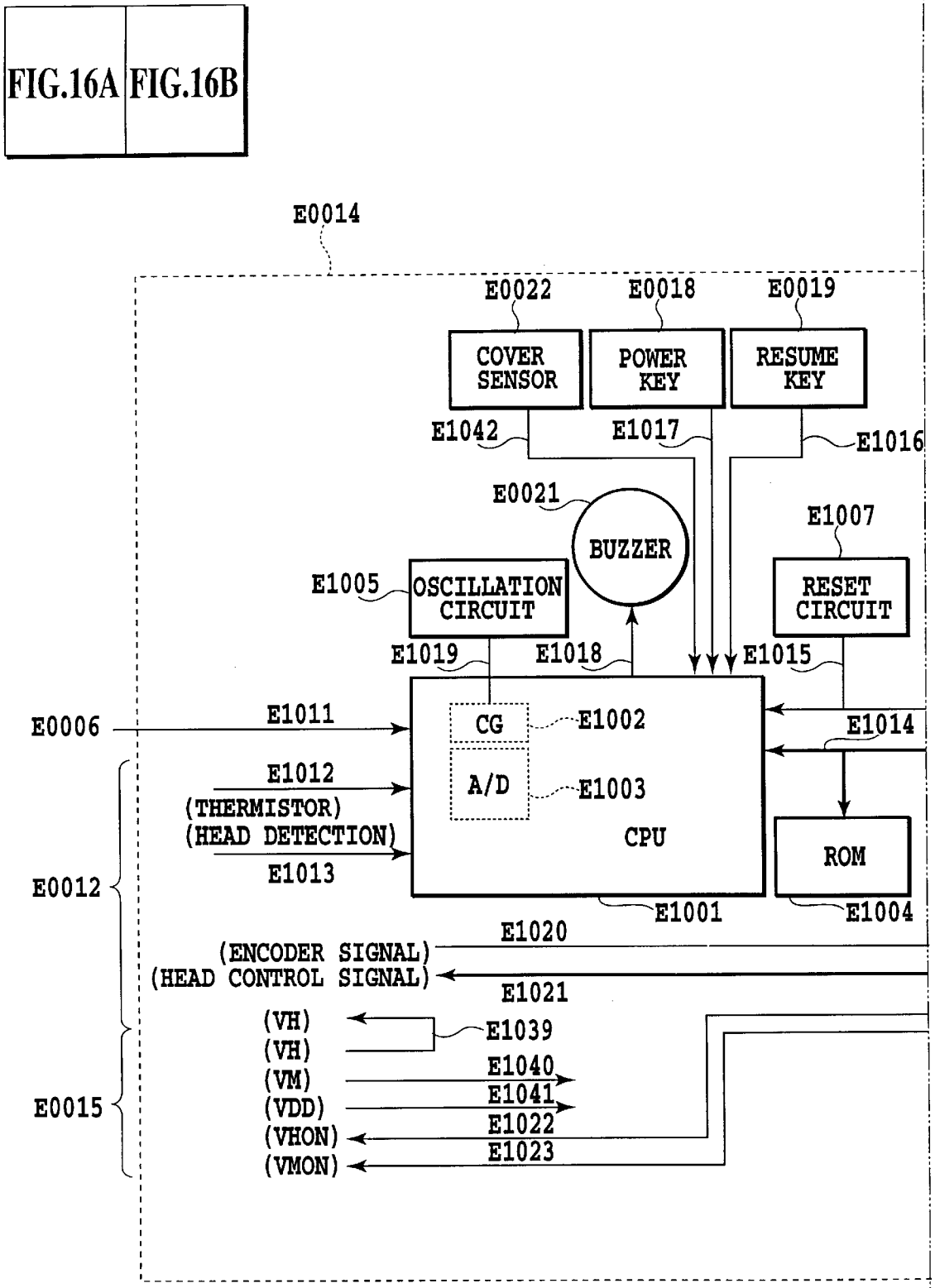
FIG. 16 is a diagram showing the relation between FIGS. 16A and 16B, FIGS. 16A and 16B being block diagrams representing an example inner configuration of a main printed circuit board (PCB) in the electric circuitry of FIG. 15.
Figure 16B:
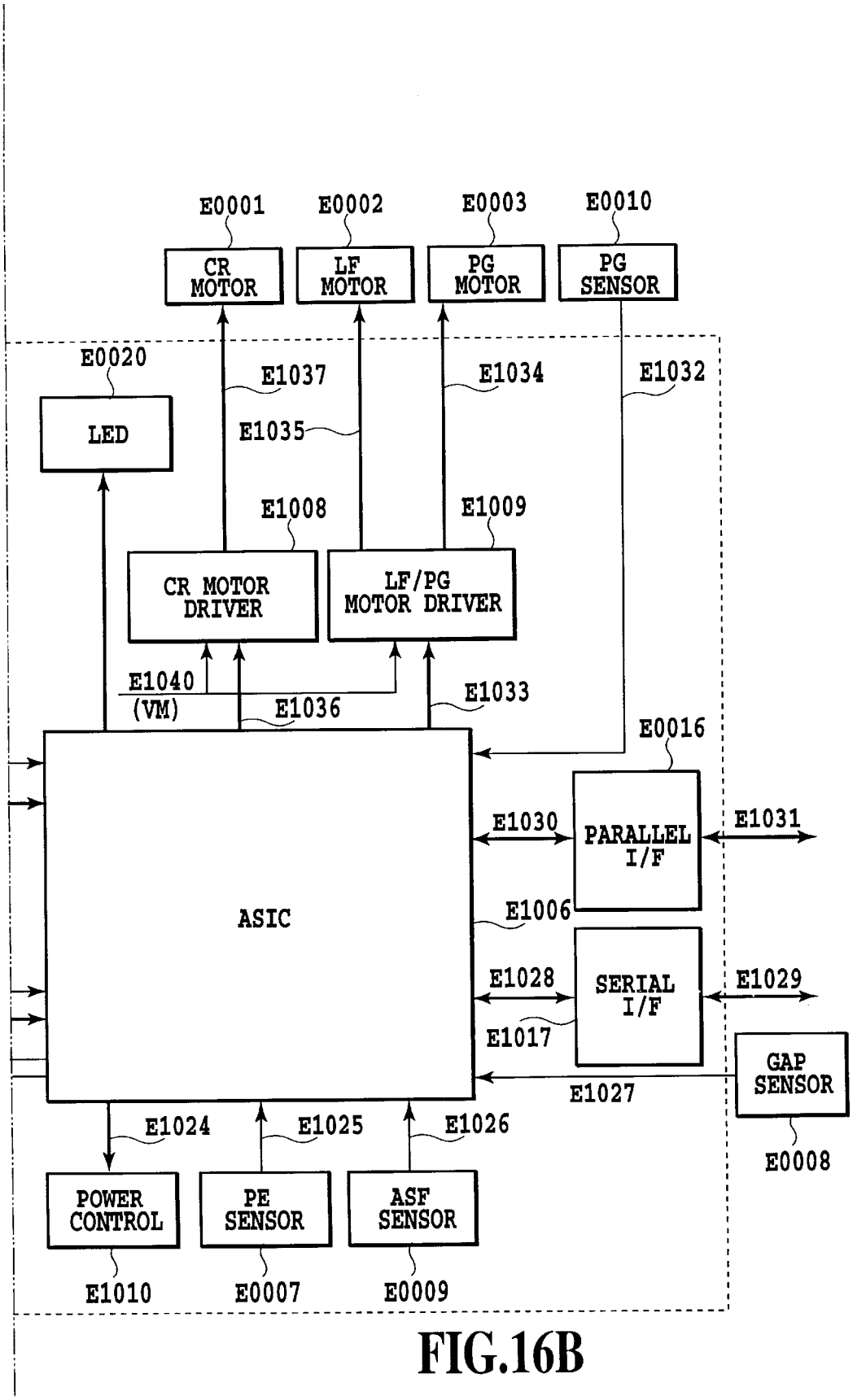

FIG. 16 is a diagram showing the relation between FIGS. 16A and 16B, and FIGS. 16A and 16B are block diagrams showing an inner configuration of the main PCB E0014.

Reference number E1001 represents a CPU, which has a clock generator (CG) E1002 connected to an oscillation circuit E1005 to generate a system clock based on an output signal E1019 of the oscillation circuit E1005. The CPU E1001 is connected to an ASIC (application specific integrated circuit) and a ROM E1004 through a control bus E1014. According to a program stored in the ROM E1004, the CPU E1001 controls the ASIC E1006, checks the status of an input signal E1017 from the power key, an input signal E1016 from the resume key, a cover detection signal E1042 and a head detection signal (HSENS) E1013, drives the buzzer E0021 according to a buzzer signal (BUZ) E1018, and checks the status of an ink empty detection signal (INKS) E1011 connected to a built-in A/D converter E1003 and of a temperature detection signal (TH) E1012 from a thermistor. The CPU E1001 also performs various other logic operations and makes conditional decisions to control the operation of the ink jet printing apparatus.

The head detection signal E1013 is a head mount detection signal entered from the print head cartridge H1000 through the flexible flat cable E0012, the carriage substrate E0013 and the contact FPC E0011. The ink empty detection signal E1011 is an analog signal output from the ink empty sensor E0006. The temperature detection signal E1012 is an analog signal from the thermistor (not shown) provided on the carriage substrate E0013.

Designated E1008 is a CR motor driver that uses a motor power supply (VM) E1040 to generate a CR motor drive signal E1037 according to a CR motor control signal E1036 from the ASIC E1006 to drive the CR motor E0001. E1009 designates an LF/PG motor driver which uses the motor power supply E1040 to generate an LF motor drive signal E1035 according to a pulse motor control signal (PM control signal) E1033 from the ASIC E1006 to drive the LF motor. The LF/PG motor driver E1009 also generates a PG motor drive signal E1034 to drive the PG motor.

Designated E1010 is a power supply control circuit which controls the supply of electricity to respective sensors with light emitting elements according to a power supply control signal E1024 from the ASIC E1006. The parallel I/F E0016 transfers a parallel I/F signal E1030 from the ASIC E1006 to a parallel I/F cable E1031 connected to external circuits and also transfers a signal of the parallel I/F cable E1031 to the ASIC E1006. The serial I/F E0017 transfers a serial I/F signal E1028 from the ASIC E1006 to a serial I/F cable E1029 connected to external circuits, and also transfers a signal from the serial I/F cable E1029 to the ASIC E1006.

The power supply unit E0015 provides a head power signal (VH) E1039, a motor power signal (VM) E1040 and a logic power signal (VDD) E1041. A head power ON signal (VHON) E1022 and a motor power ON signal (VMON) E1023 are sent from the ASIC E1006 to the power supply unit E0015 to perform the ON/OFF control of the head power signal E1039 and the motor power signal E1040. The logic power signal (VDD) E1041 supplied from the power supply unit E0015 is voltage-converted as required and given to various parts inside or outside the main PCB E0014.

The head power signal E1039 is smoothed by a circuit of the main PCB E0014 and then sent out to the flexible flat cable E0011 to be used for driving the print head cartridge H1000. E1007 denotes a reset circuit which detects a reduction in the logic power signal E1041 and sends a reset signal (RESET) to the CPU E1001 and the ASIC E1006 to initialize them.

The ASIC E1006 is a single-chip semiconductor integrated circuit and is controlled by the CPU E1001 through the control bus E1014 to output the CR motor control signal E1036, the PM control signal E1033, the power supply control signal E1024, the head power ON signal E1022 and the motor power ON signal E1023. It also transfers signals to and from the parallel interface E0016 and the serial interface E0017. In addition, the ASIC E1006 detects the status of a PE detection signal (PES) E1025 from the PE sensor E0007, an ASF detection signal (ASFS) E1026 from the ASF sensor E0009, a gap detection signal (GAPS) E1027 from the GAP sensor E0008 for detecting a gap between the print head and the printing medium, and a PG detection signal (PGS) E1032 from the PG sensor E0010, and sends data representing the statuses of these signals to the CPU E1001 through the control bus E1014. Based on the data received, the CPU E1001 controls the operation of an LED drive signal E1038 to turn on or off the LED E0020.

Further, the ASIC E1006 checks the status of an encoder signal (ENC) E1020, generates a timing signal, interfaces with the print head cartridge H1000 and controls the print operation by a head control signal E1021. The encoder signal (ENC) E1020 is an output signal of the CR encoder sensor E0004 received through the flexible flat cable E0012. The head control signal E1021 is sent to the print head H1001 through the flexible flat cable E0012, carriage substrate E0013 and contact FPC E0011.

Figures 17, 17A:
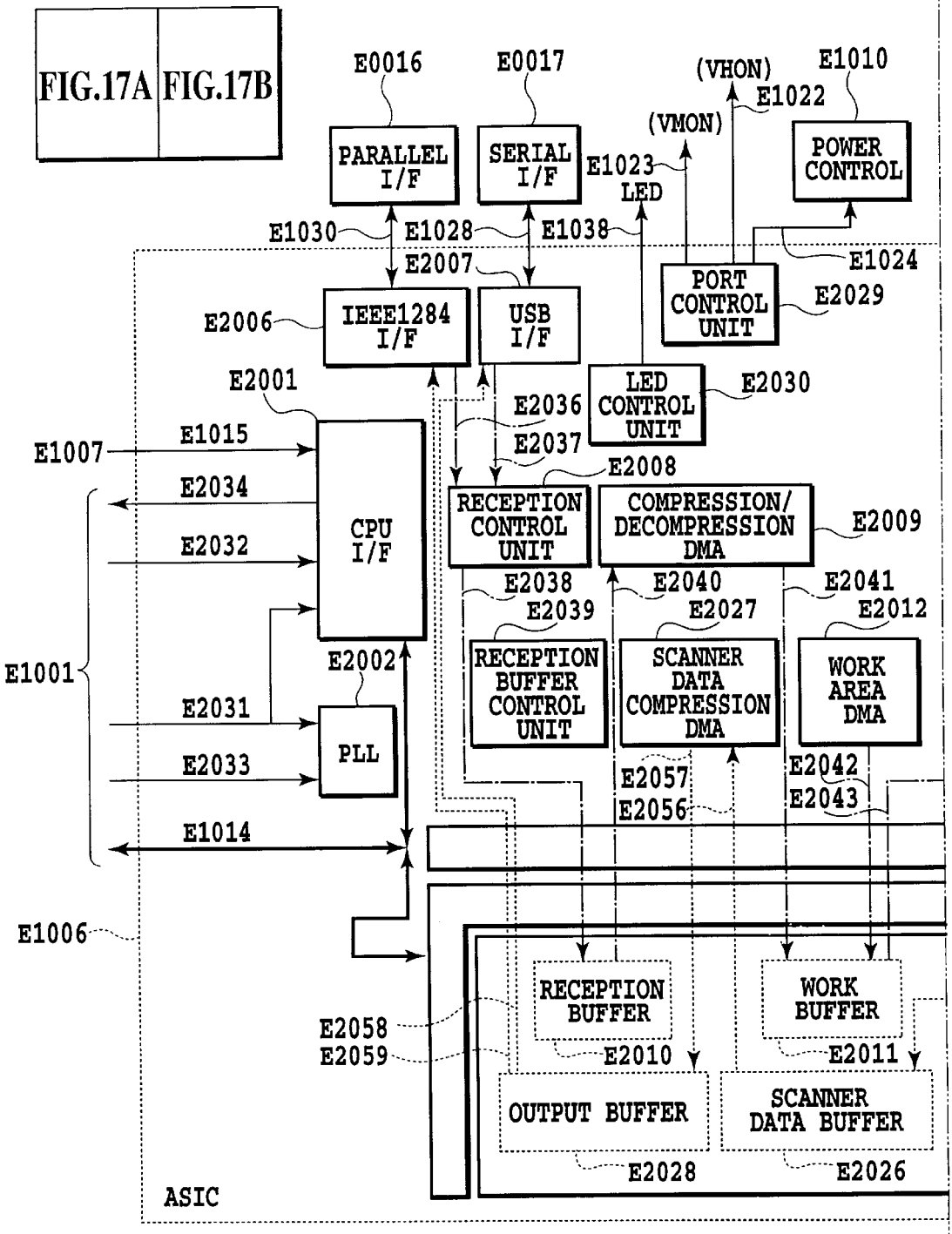
FIG. 17 is a diagram showing the relation between FIGS. 17A and 17B, FIGS. 17A and 17B being block diagrams representing an example inner configuration of an application specific integrated circuit (ASIC) in the main PCB of FIGS. 16A and 16B.
Figure 17B:
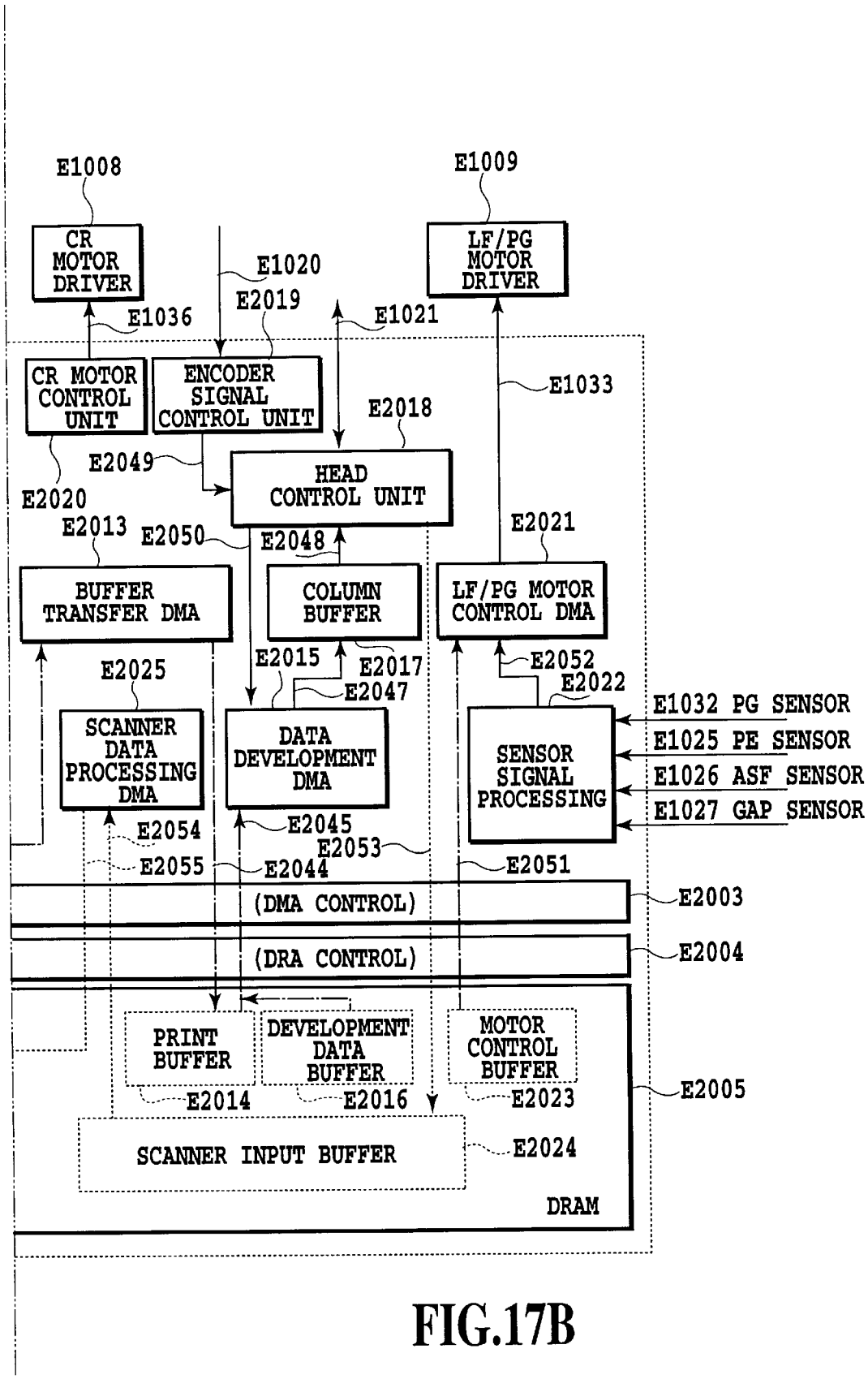

FIG. 17 is a diagram showing the relation between FIGS. 17A and 17B, and FIGS. 17A and 17B are block diagrams showing an example internal configuration of the ASIC E1006.

In these figures, only the flow of data, such as print data and motor control data, associated with the control of the head and various mechanical components is shown between each block, and control signals and clock associated with the read/write operation of the registers incorporated in each block and control signals associated with the DMA control are omitted to simplify the drawing.

In the figures, reference number E2002 represents a PLL controller which, based on a clock signal (CLK) E2031 and a PLL control signal (PLLON) E2033 output from the CPU E1001 shown in FIG. 16A, generates a clock (not shown) to be supplied to the most part of the ASIC E1006.

Denoted E2001 is a CPU interface (CPU I/F) E2001, which controls the read/write operation of register in each block, supplies a clock to some blocks and accepts an interrupt signal (none of these operations are shown) according to a reset signal E1015, a software reset signal (PDWN) E2032 and a clock signal (CLK) E2031 output from the CPU E1001, and control signals from the control bus E1014. The CPU I/F E2001 then outputs an interrupt signal (INT) E2034 to the CPU E1001 to inform it of the occurrence of an interrupt within the ASIC E1006.

E2005 denotes a DRAM which has various areas for storing print data, such as a reception buffer E2010, a work buffer E2011, a print buffer E2014 and a development data buffer E2016. The DRAM E2005 also has a motor control buffer E2023 for motor control and, as buffers used instead of the above print data buffers during the scanner operation mode, a scanner input buffer E2024, a scanner data buffer E2026 and an output buffer E2028.

The DRAM E2005 is also used as a work area by the CPU E1001 for its own operation. Designated E2004 is a DRAM control unit E2004 which performs read/write operations on the DRAM E2005 by switching between the DRAM access from the CPU E1001 through the control bus and the DRAM access from a DMA control unit E2003 described later.

The DMA control unit E2003 accepts request signals (not shown) from various blocks and outputs address signals and control signals (not shown) and, in the case of write operation, write data E2038, E2041, E2044, E2053, E2055, E2057 etc. to the DRAM control unit to make DRAM accesses. In the case of read operation, the DMA control unit E2003 transfers the read data E2040, E2043, E2045, E2051, E2054, E2056, E2058, E2059 from the DRAM control unit E2004 to the requesting blocks.

Denoted E2006 is an IEEE 1284 I/F which functions as a bi-directional communication interface with external host devices, not shown, through the parallel I/F E0016 and is controlled by the CPU E1001 via CPU I/F E2001. During the printing operation, the IEEE 1284 I/F E2006 transfers the receive data (PIF receive data E2036) from the parallel I/F E0016 to a reception control unit E2008 by the DMA processing. During the scanner reading operation, the 1284 I/F E2006 sends the data (1284 transmit data (RDPIF) E2059) stored in the output buffer E2028 in the DRAM E2005 to the parallel I/F E0016 by the DMA processing.

Designated E2007 is a universal serial bus (USB) I/F which offers a bi-directional communication interface with external host devices, not shown, through the serial I/F E0017 and is controlled by the CPU E1001 through the CPU I/F E2001. During the printing operation, the universal serial bus (USB) I/F E2007 transfers received data (USB receive data E2037) from the serial I/F E0017 to the reception control unit E2008 by the DMA processing. During the scanner reading, the universal serial bus (USB) I/F E2007 sends data (USB transmit data (RDUSB) E2058) stored in the output buffer E2028 in the DRAM E2005 to the serial I/F E0017 by the DMA processing. The reception control unit E2008 writes data (WDIF E2038) received from the 1284 I/F E2006 or universal serial bus (USB) I/F E2007, whichever is selected, into a reception buffer write address managed by a reception buffer control unit E2039. Designated E2009 is a compression/decompression DMA controller which is controlled by the CPU E1001 through the CPU I/F E2001 to read received data (raster data) stored in a reception buffer E2010 from a reception buffer read address managed by the reception buffer control unit E2039, compress or decompress the data (RDWK) E2040 according to a specified mode, and write the data as a print code string (WDWK) E2041 into the work buffer area.

Designated E2013 is a print buffer transfer DMA controller which is controlled by the CPU E1001 through the CPU I/F E2001 to read print codes (RDWP) E2043 on the work buffer E2011 and rearrange the print codes onto addresses on the print buffer E2014 that match the sequence of data transfer to the print head cartridge H1000 before transferring the codes (WDWP E2044). Reference number E2012 denotes a work area DMA controller which is controlled by the CPU E1001 through the CPU I/F E2001 to repetitively write specified work fill data (WDWF) E2042 into the area of the work buffer whose data transfer by the print buffer transfer DMA controller E2013 has been completed.

Designated E2015 is a print data development DMA controller E2015, which is controlled by the CPU E1001 through the CPU I/F E2001. Triggered by a data development timing signal E2050 from a head control unit E2018, the print data development DMA controller E2015 reads the print code that was rearranged and written into the print buffer and the development data written into the development data buffer E2016 and writes developed print data (RDHDG) E2045 into the column buffer E2017 as column buffer write data (WDHDG) E2047. The column buffer E2017 is an SRAM that temporarily stores the transfer data (developed print data) to be sent to the print head cartridge H1000, and is shared and managed by both the print data development DMA CONTROLLER and the head control unit through a handshake signal (not shown).

Designated E2018 is a head control unit E2018 which is controlled by the CPU E1001 through the CPU I/F E2001 to interface with the print head cartridge H1000 or the scanner-through the head control signal. It also outputs a data development timing signal E2050 to the print data development DMA controller according to a head drive timing signal E2049 from the encoder signal processing unit E2019.

During the printing operation, the head control unit E2018, when it receives the head drive timing signal E2049, reads developed print data (RDHD) E2048 from the column buffer and outputs the data to the print head cartridge H1000 as the head control signal E1021.

In the scanner reading mode, the head control unit E2018 DMA-transfers the input data (WDHD) E2053 received as the head control signal E1021 to the scanner input buffer E2024 on the DRAM E2005. Designated E2025 is a scanner data processing DMA controller E2025 which is controlled by the CPU E1001 through the CPU I/F E2001 to read input buffer read data (RDAV) E2054 stored in the scanner input buffer E2024 and writes the averaged data (WDAV) E2055 into the scanner data buffer E2026 on the DRAM E2005.

Designated E2027 is a scanner data compression DMA controller which is controlled by the CPU E1001 through the CPU I/F E2001 to read processed data (RDYC) E2056 on the scanner data buffer E2026, perform data compression, and write the compressed data (WDYC) E2057 into the output buffer E2028 for transfer.

Designated E2019 is an encoder signal processing unit which, when it receives an encoder signal (ENC), outputs the head drive timing signal E2049 according to a mode determined by the CPU E1001. The encoder signal processing unit E2019 also stores in a register information on the position and speed of the carriage M4001 obtained from the encoder signal E1020 and presents it to the CPU E1001. Based on this information, the CPU E1001 determines various parameters for the CR motor E0001. Designated E2020 is a CR motor control unit which is controlled by the CPU E1001 through the CPU I/F E2001 to output the CR motor control signal E1036.

Denoted E2022 is a sensor signal processing unit which receives detection signals E1032, E1025, E1026 and E1027 output from the PG sensor E0010, the PE sensor E0007, the ASF sensor E0009 and the gap sensor E0008, respectively, and transfers these sensor information to the CPU E1001 according to the mode determined by the CPU E1001. The sensor signal processing unit E2022 also outputs a sensor detection signal E2052 to a DMA controller E2021 for controlling LF/PG motor.

The DMA controller E2021 for controlling LF/PG motor is controlled by the CPU E1001 through the CPU I/F E2001 to read a pulse motor drive table (RDPM) E2051 from the motor control buffer E2023 on the DRAM E2005 and output a pulse motor control signal E1033. Depending on the operation mode, the controller outputs the pulse motor control signal E1033 upon reception of the sensor detection signal as a control trigger.

Designated E2030 is an LED control unit which is controlled by the CPU E1001 through the CPU I/F E2001 to output an LED drive signal E1038. Further, designated E2029 is a port control unit which is controlled by the CPU E1001 through the CPU I/F E2001 to output the head power ON signal E1022, the motor power ON signal E1023 and the power supply control signal E1024.

I.9 Operation of Printer

Figure 18:
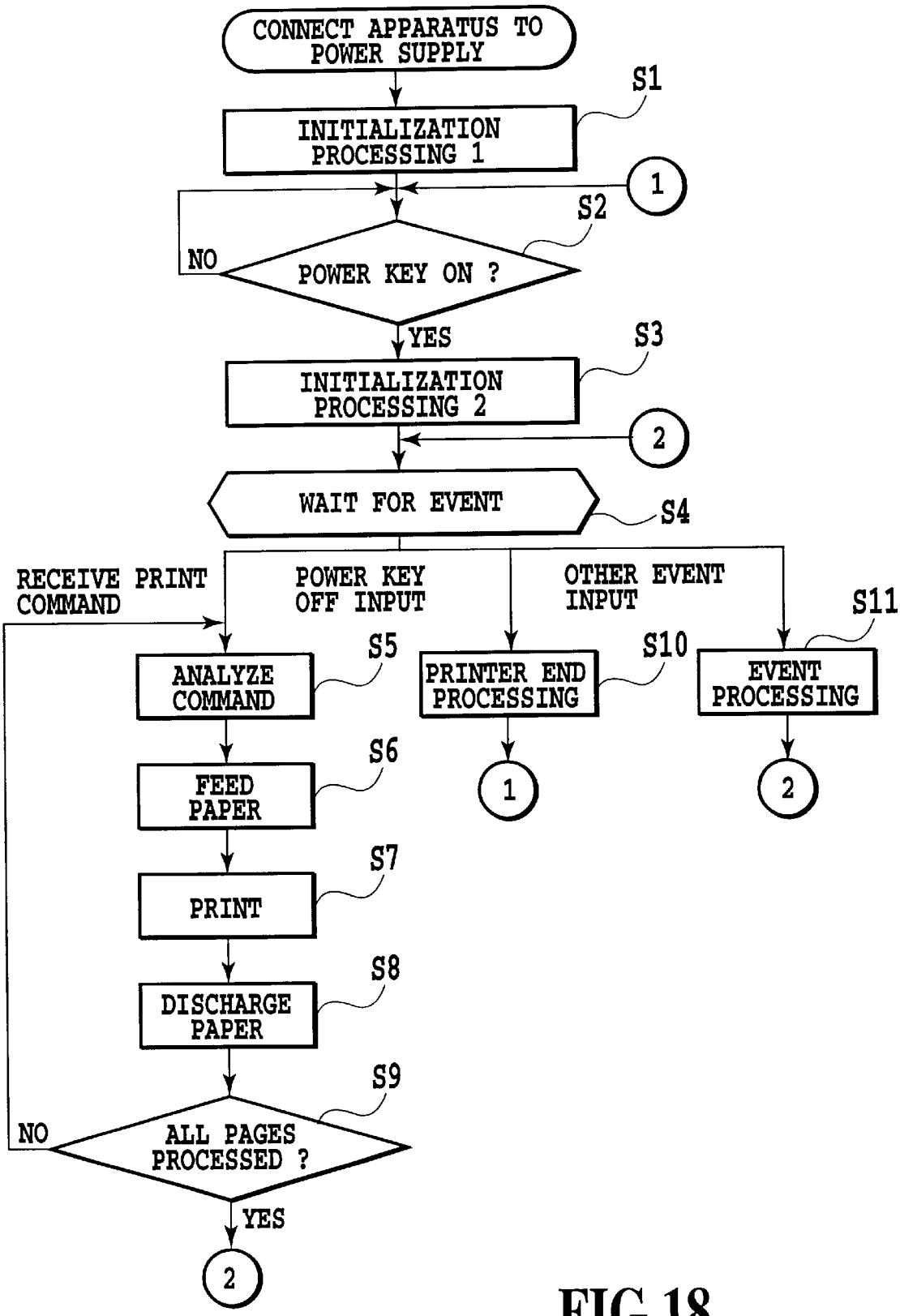
FIG. 18 is a flow chart showing an example of operation of the printer as one embodiment of the present invention.

Next, the operation of the ink jet printing apparatus in this embodiment of the invention with the above configuration will be explained by referring to the flow chart of FIG. 18.

When the printer body M1000 is connected to an AC power supply, a first initialization is performed at step S1. In this initialization process, the electric circuit system including the ROM and RAM in the apparatus is checked to confirm that the apparatus is electrically operable.

Next, step S2 checks if the power key E0018 on the upper case M1002 of the printer body M1000 is turned on. When it is decided that the power key E0018 is pressed, the processing moves to the next step S3 where a second initialization is performed.

In this second initialization, a check is made of various drive mechanisms and the print head of this apparatus. That is, when various motors are initialized and head information is read, it is checked whether the apparatus is normally operable.

Next, steps S4 waits for an event. That is, this step monitors a demand event from the external I/F, a panel key event from the user operation and an internal control event and, when any of these events occurs, executes the corresponding processing.

When, for example, step S4 receives a print command event from the external I/F, the processing moves to step S5. When a power key event from the user operation occurs at step S4, the processing moves to step S10. If another event occurs, the processing moves to step S11.

Step S5 analyzes the print command from the external I/F, checks a specified paper kind, paper size, print quality, paper feeding method and others, and stores data representing the check result into the DRAM E2005 of the apparatus before proceeding to step S6.

Next, step S6 starts feeding the paper according to the paper feeding method specified by the step S5 until the paper is situated at the print start position. The processing moves to step S7.

At step S7 the printing operation is performed. In this printing operation, the print data sent from the external I/F is stored temporarily in the print buffer. Then, the CR motor E0001 is started to move the carriage M4001 in the main-scanning direction. At the same time, the print data stored in the print buffer E2014 is transferred to the print head H1001 to print one line. When one line of the print data has been printed, the LF motor E0002 is driven to rotate the LF roller M3001 to transport the paper in the sub-scanning direction. After this, the above operation is executed repetitively until one page of the print data from the external I/F is completely printed, at which time the processing moves to step S8.

At step S8, the LF motor E0002 is driven to rotate the paper discharge roller M2003 to feed the paper until it is decided that the paper is completely fed out of the apparatus, at which time the paper is completely discharged onto the paper discharge tray M1004.

Next at step S9, it is checked whether all the pages that need to be printed have been printed and if there are pages that remain to be printed, the processing returns to step S5 and the steps S5 to S9 are repeated. When all the pages that need to be printed have been printed, the print operation is ended and the processing moves to step S4 waiting for the next event.

Step S10 performs the printing termination processing to stop the operation of the apparatus. That is, to turn off various motors and print head, this step renders the apparatus ready to be cut off from power supply and then turns off power, before moving to step S4 waiting for the next event.

Step S11 performs other event processing. For example, this step performs processing corresponding to the ejection performance recovery command from various panel keys or external I/F and the ejection performance recovery event that occurs internally. After the recovery processing is finished, the printer operation moves to step S4 waiting for the next event.

II. Characteristic Configuration

Next, an embodiment of a characteristic configuration of the present invention in a printer having a "basic configuration" such as that described above will be described with reference to the drawings.

First Embodiment

FIGS. 19 to 23 are views useful for explaining a pressure generating apparatus according to a first embodiment of the present invention. The pressure generating apparatus according to this example include a pump (hereafter referred to as a "tube pump") M5100.

Figure 19:
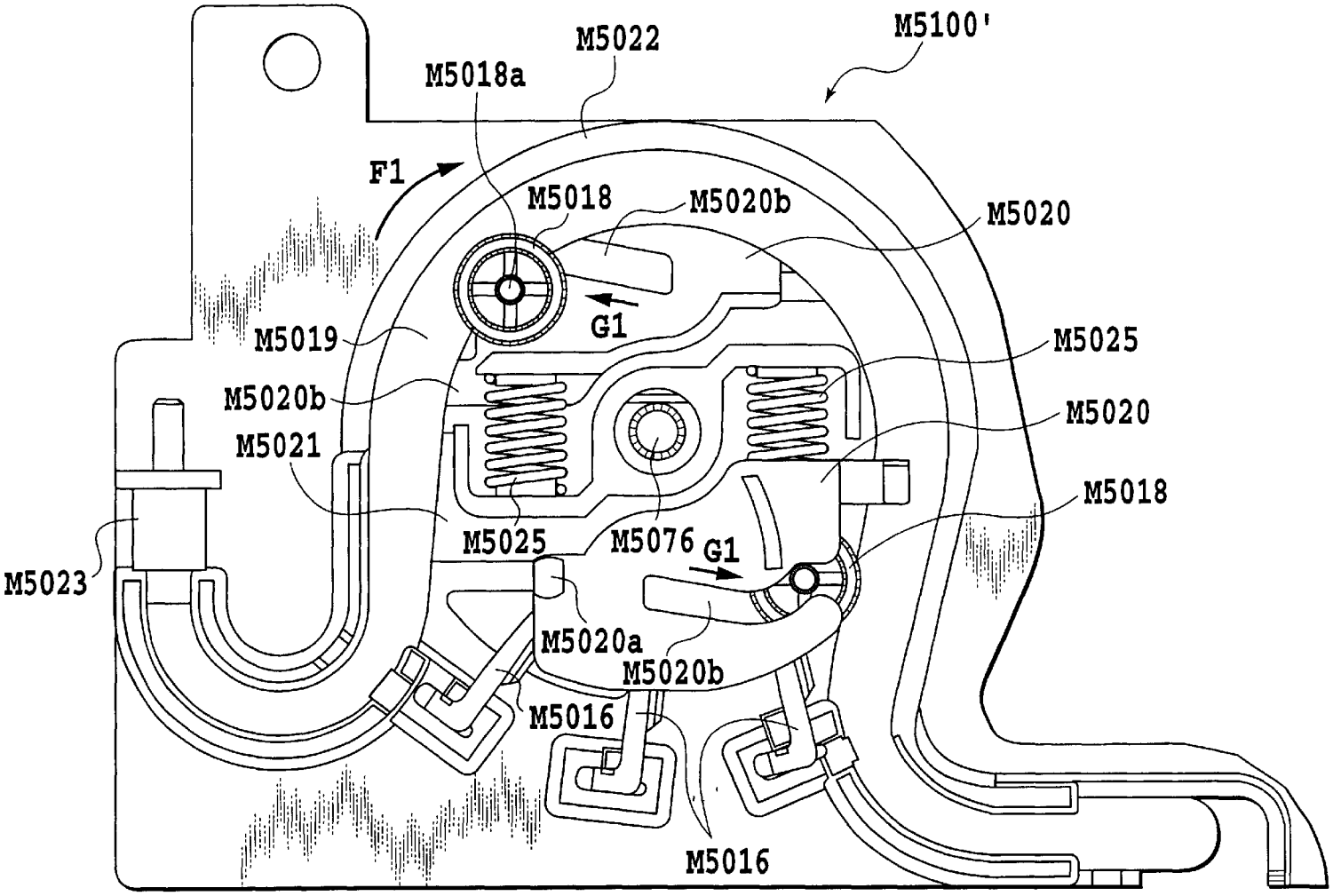
FIG. 19 is a view showing the internal configuration of a tube pump and which is useful for explaining the characteristic configuration of a first embodiment of the present invention.
Figure 20:
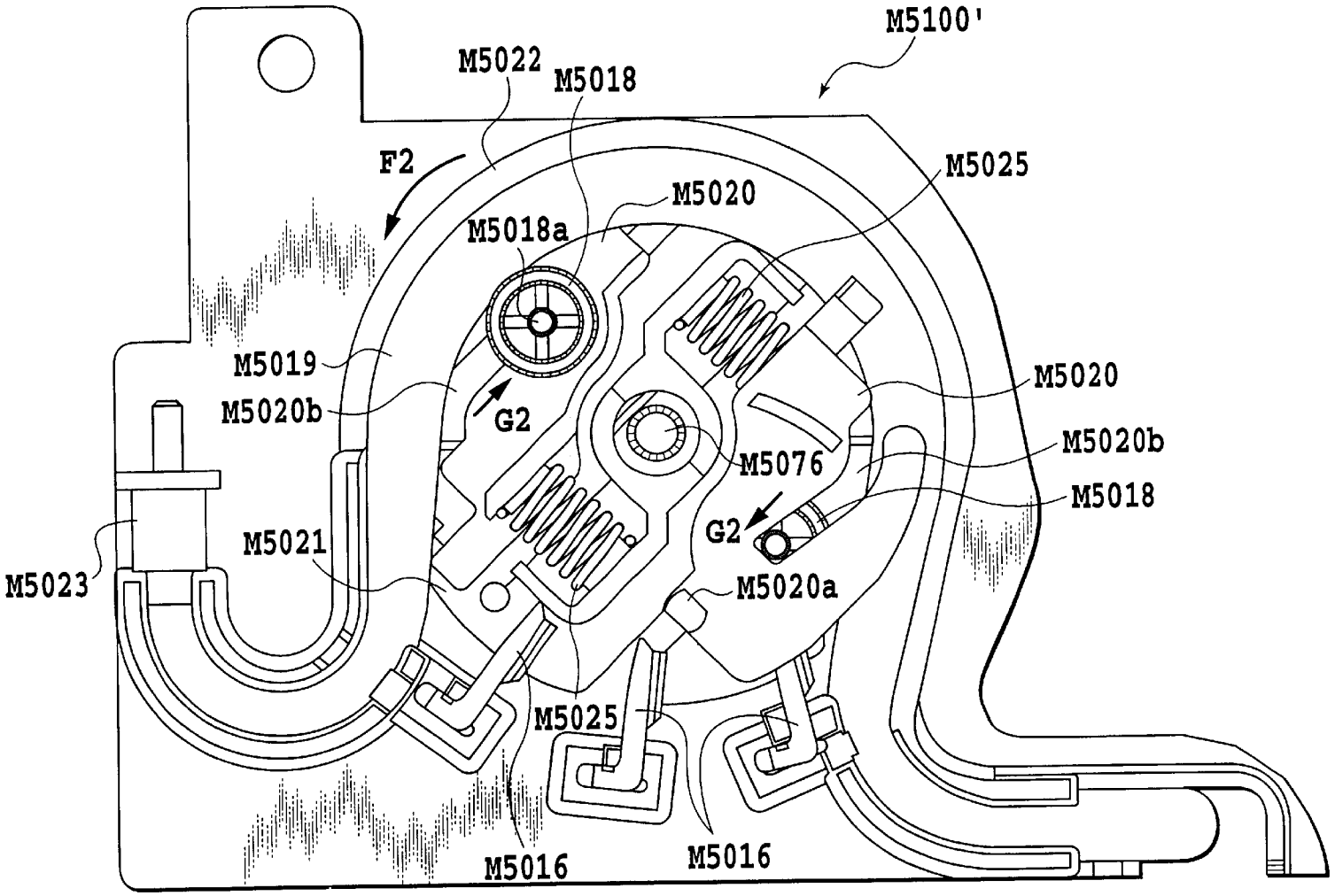
FIG. 20 is a view showing the internal configuration of the tube pump in FIG. 19 in a different operational state.

In the tube pump M5100, reference numeral M5019 denotes an elastic pump tube and reference numeral M5022 denotes a pump tube guide. The pump tube guide M5022 has a semicylindrical inner wall extending over 180° or more around a pump center shaft M5076, and pump tube M5019 disposed along the inner wall. Reference numeral M5021 denotes a pump roller guide rotatably supported on the pump center shaft M5076. Two pump roller holders M5020 are held on the pump roller guide M5021 so as to be rotated by a rotating shaft 5020*a* and to have an angular phase difference of 180° around the pump center shaft M5076. In FIGS. 19 and 20 shows only the rotating shaft M5020*a* for one of the pump roller holder M5020. Each pump roller holder M5020 has a movement groove M5020*b* for rotatably and movably guiding a pump roller M5018. The pump roller M5018 comes in pressure contact with the pump tube M5019 to squeeze it to generate pressure therein. A pump roller pressure contact spring M5025 that brings the pump roller M5018 into pressure contact with the pump tube M5019 is provided between each pump roller holder M5020 and the pump roller guide M5021. Reference numeral M5018*a* denotes a shaft of the pump roller M5018, and reference numeral M5023 denotes a pump tube joint.

The pump roller M5018 is brought into pressure contact with the pump tube M5019 and has the pressure contact released depending on a rotating direction of the pump roller guide M5021.

That is, when the pump roller guide M5021 is rotated in an arrow F1 direction as shown in FIG. 19, the pump roller M5018 is moved, at a position opposed to a roller damper M5016, through the movement groove M5020*b* in an arrow G1 direction due to an urging force effected by the roller damper M5016. Thus, the distance between the pump roller 5018 and the pump center shaft M5076 becomes relatively large, so that the pump roller 5018 is brought into pressure contact with the pump tube M5019. Then, the pump roller guide M5021 rotates in the arrow F1 direction while the pressure contact between the pump roller M5018 and the pump tube M5019 remains. Consequently, the pump tube M5019 is squeezed between the pump tube guide M5022 and the pump roller M5018 to generate pressure inside the pump tube M5019.

On the other hand, when the pump roller guide M5021 is rotated in an arrow F2 direction as shown in FIG. 20, the pump roller M5018 moves through the movement groove M5020*b* in the arrow G2 direction due to a frictional force effected between the pump roller M5018 and the pump tube M5019. The distance between the pump roller 5018 and the pump center shaft M5076 becomes relatively small, so that the pressure contact between the pump roller M5018 and the pump tube M5019 is released. Then, the pump roller guide M5021 rotates in the arrow F2 direction while the pressure contact between the pump roller M5018 and the pump tube M5019 is released. As a result, the pump tube M5019 is prevented from being squeezed between the pump tube guide M5022 and the pump roller M5018, and no pressure is generated inside the pump tube M5019.

Figure 21:
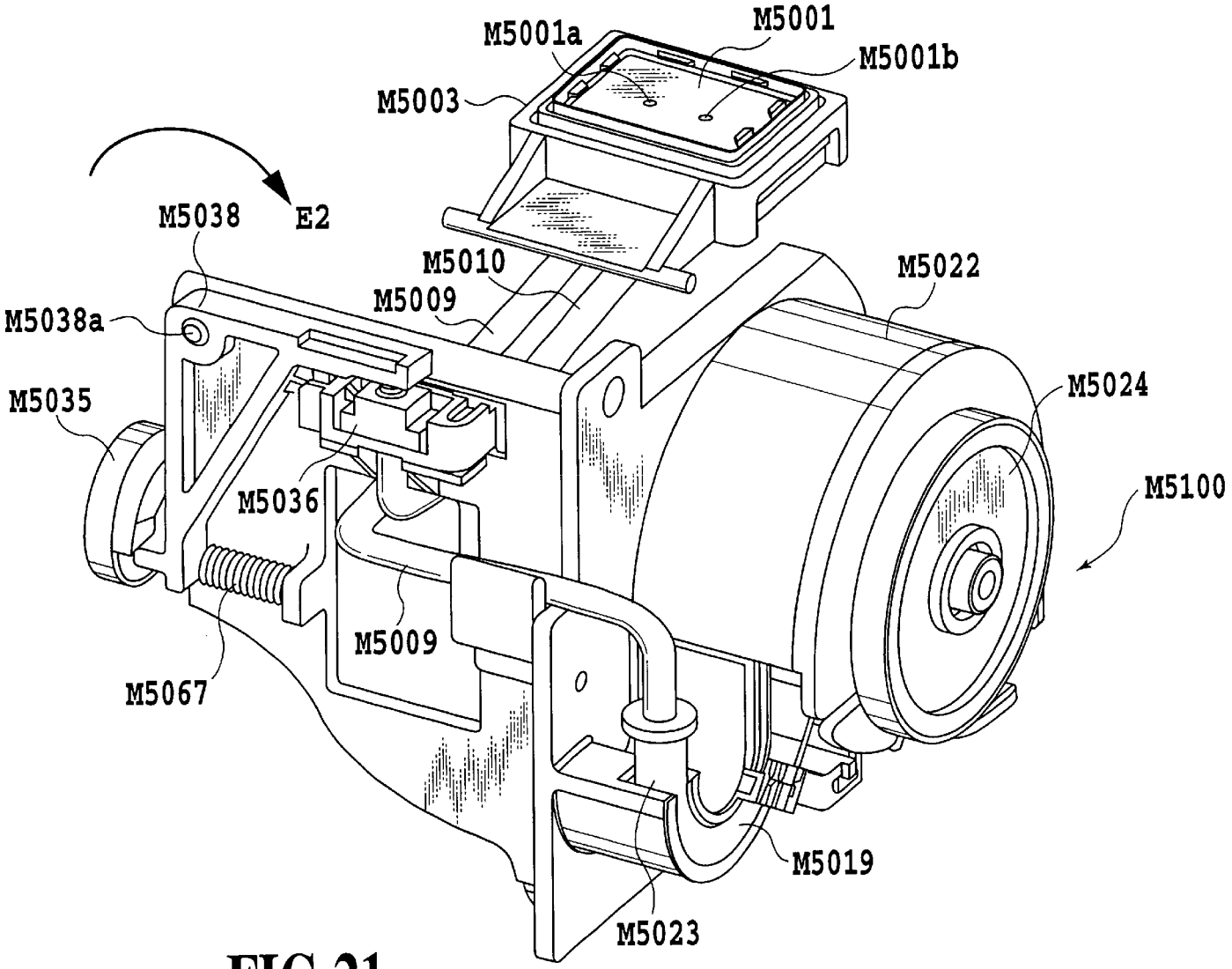
FIG. 21 is a perspective view showing an integral part of a printing apparatus including the tube pump in FIG. 19.
Figure 22:
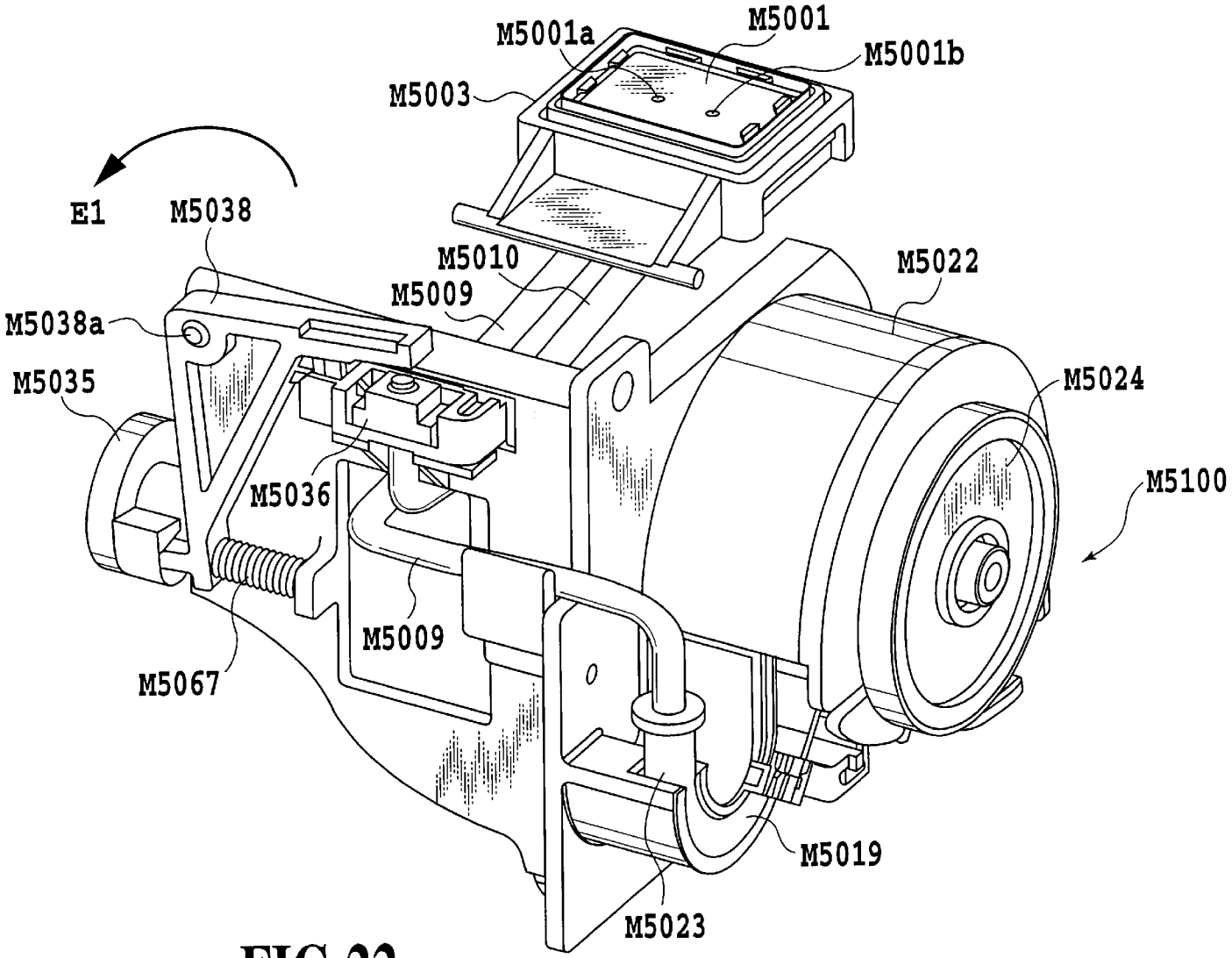
FIG. 22 is a perspective view showing an integral part of the printing apparatus including the tube pump in FIG. 19 in a different operational state.

As described above, the tube pump M5100 is connected to the other side of a PG motor E0003 via a drive switching means and a pump drive transmission gear train M5130. The drive switching means switches a transmission path for a driving force for the tube pump M5100 and the automatic feed means M3022. In addition, the pump tube M5019 has one end connected to the cap M5001 via the cap tube M5009 as shown in FIGS. 21 and 22. The cap M5001 has a suction port M5001*a* and an air communication port M5001*b* formed therein. The suction port M5001*a* has the cap tube M5009 connected thereto and the valve tube M5010 connected to the air communication port 5001*b*. Additionally, reference numeral M5003 denotes a cap holder, reference numeral M5024 denotes pump gear, and reference numeral M5067 denotes a valve lever spring. As described above, when the valve lever M5038 rotatively moves in the arrow E1 or E2 direction, the valve rubber M5036 is opened or closed, respectively, to in turn open or close the valve tube M5010 connected to the air communication port M5001*b* of the cap M5001.

Figure 23:
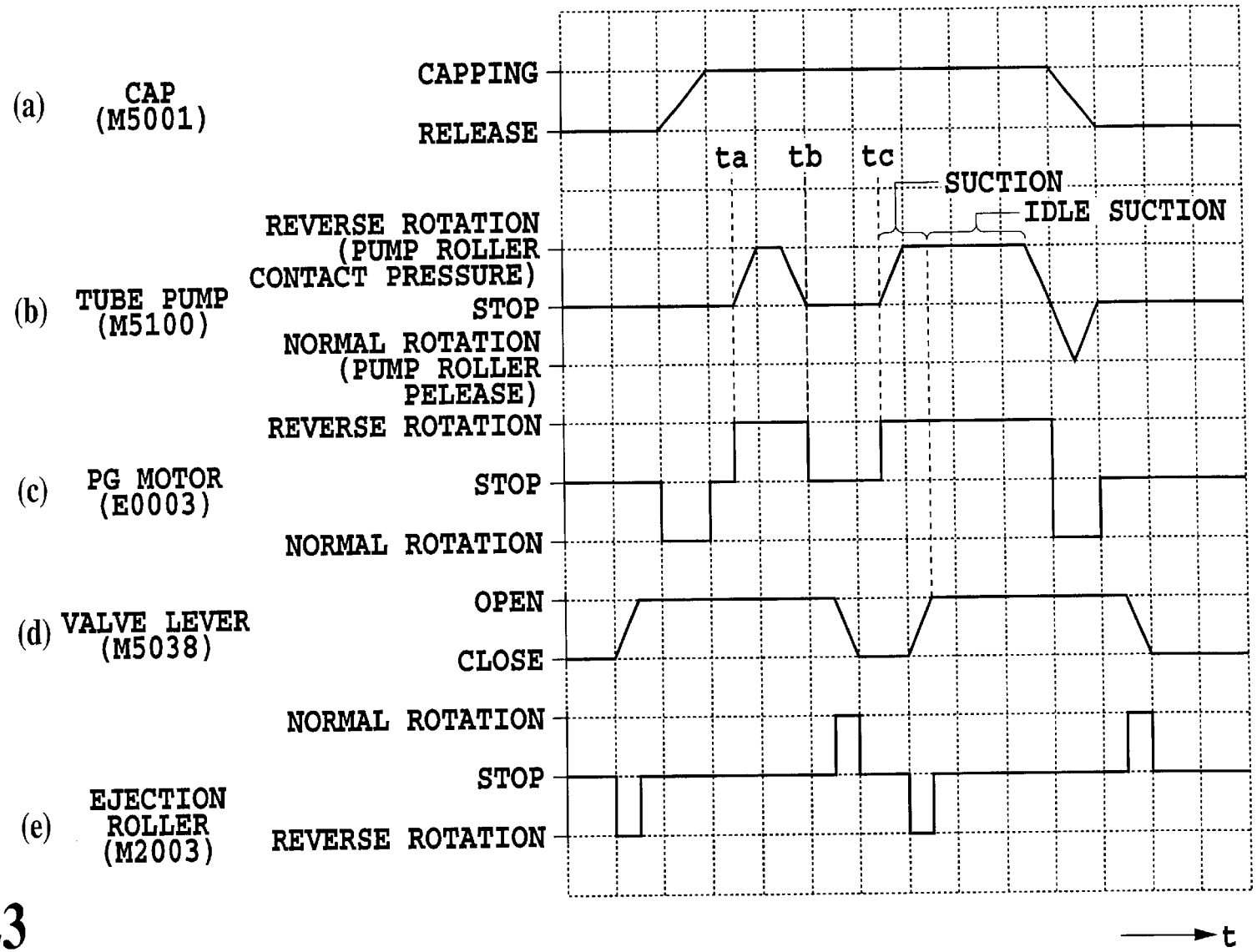
FIG. 23 is a timing chart useful for explaining the operation of the tube pump in FIG. 19.

Next, characteristic operations of the tube pump M5100 will be described (see FIG. 23).

Figure 25:
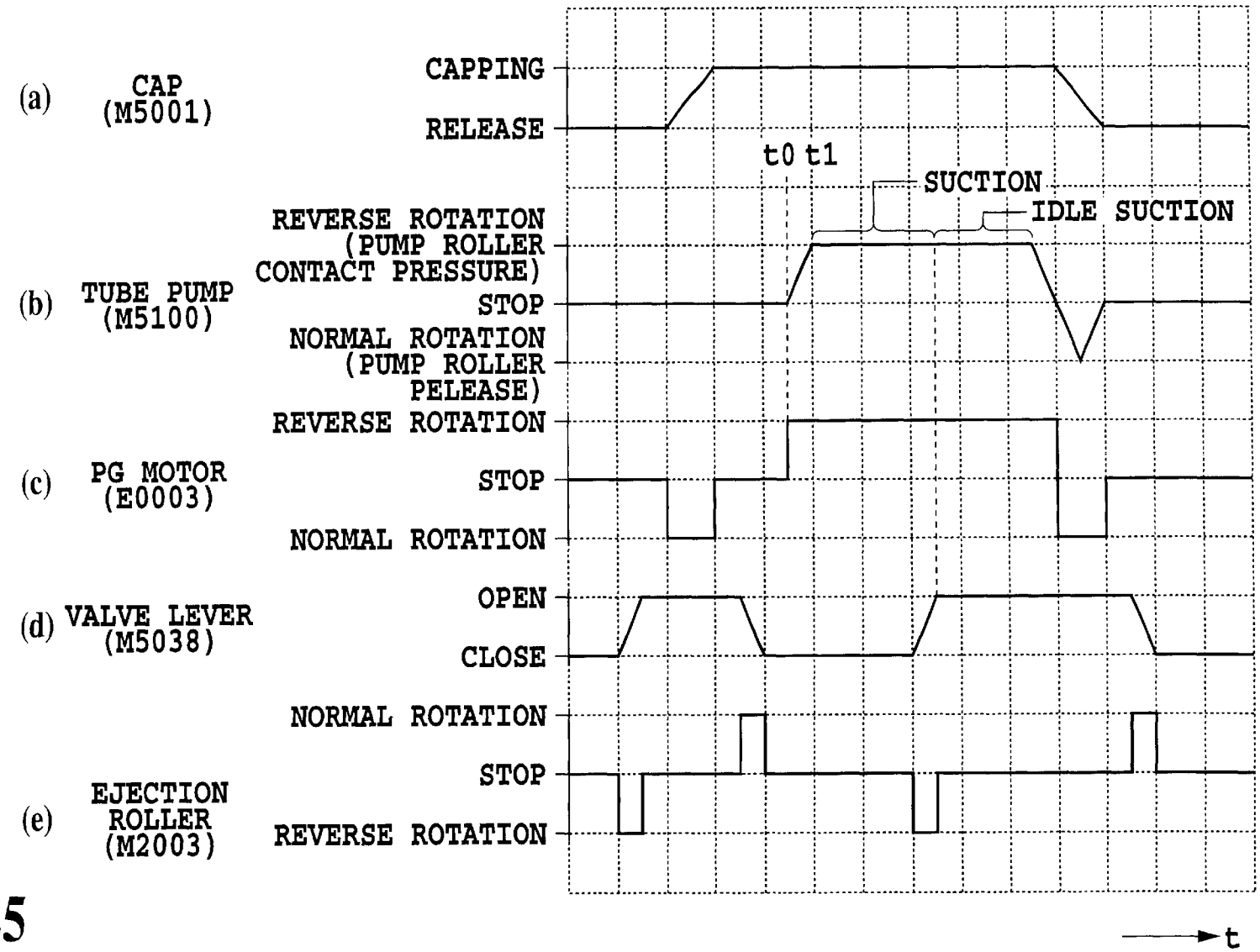
FIG. 25 is a timing chart useful for explaining the operation of a conventional tube pump.

The cap M5001 and the tube pump M5100 are driven correlatively depending on a rotating direction of the PG motor E0003, as shown by (a), (b), and (c) in FIG. 25. Additionally, the valve lever M5038 is driven depending on a rotating direction of the ejection rollers M2003 rotated by the LF motor E0002, as shown by (d) and (e) in FIG. 23.

That is, first, the ejection rollers M2003 are reversely driven for reverse rotation to cause the valve lever M5038 to open the valve rubber M5036. The PG motor E0003 subsequently rotates forward for normal rotation to bring the cap M5001 into abutment with a surface of the printing head H1001 which has the ink ejection port formed therein, to cap the printing head H1001. At this point, the tube pump M5100 is driven in an arrow F2 direction (normal rotation), as shown in FIG. 20, due to the normal rotation of the PG motor E0003. The forward driving of the tube pump M5100, however, prevents the pump roller M5018 from coming in pressure contact with the pump tube 5019, so that the tube pump M5100 generates no pressure.

Subsequently, between points of time ta and tb, the PG motor E0003 is reversely rotated to reversely drive the tube pump M5100 in the arrow F1 direction at least by 180°. Accordingly, the pump roller M5018 passes through the position opposed to the roller damper M5016. Consequently, an active force from the roller damper M5016 causes the pump roller M5018 to move along the movement groove M5020*b* of the pump roller holder M5020 in an arrow G1 direction and into pressure contact with the pump tube M5019 (this state is hereafter referred to as a "pressure contact state"). Once the pump roller M5018 has been moved to the pressure contact position in this manner, the PG motor E0003 is stopped at a point of time tb. Since the valve rubber M5046 is open between the points of time ta and tb, no pressure is generated in the cap M5001 and no negative pressure acts on the printing element substrate H1100 of the printing head H1001.

Subsequently, the ejection rollers M2003 are forwardly driven for normal rotation to cause the valve lever M5038 to close the valve rubber M5046. Then, at a point of time tc, the PG motor E0003 is reversely rotated again to reversely drive the tube pump M5100 in the arrow F1 direction. Consequently, the pump roller M5018 rotates in the arrow F1 direction while in pressure contact with the pump tube M5019, thereby squeezing the pump tube M5019 to generate pressure therein. As a result, a negative pressure is introduced into the cap M5001 through the cap tube M5009 and acts on the printing element substrate H1100 of the printing head H1001. Therefore, ink of increased viscosity which are no longer suitable for printing as well as bubbles is forcibly sucked and ejected from the ink ejection port of the printing head.

Subsequently, the ejection rollers M2003 are reversely driven to cause the valve lever M5038 to open the valve rubber M5046. Then, the air communication port M5001*b* in the cap M5001 is opened to set the interior of the cap M5001 at atmospheric pressure. As a result, ink is prevented from being sucked or ejected from the ink ejection port of the printing head H1001. At the same time, ink inside the cap M5001, cap tube M5009, and pump tube M5019 is sucked and ejected from the other end of the pump tube M5019 into a waste ink absorbent (this operation is hereafter referred to as "idle suction").

Subsequently, the PG motor E0003 is stopped, and the ejection rollers M2003 are forwardly driven for normal rotation. Thus, the cap M5001 is separated from the ink ejection port forming surface of the printing head H1001 to release the capping to cause, and the valve lever M5038 close the valve rubber M5046. In this case, the PG motor E0003 stops after a small amount of normal rotation. Accordingly, the tube pump M5100 moves through the movement groove M5020*b* in an arrow G2 direction and is thus prevented from coming in pressure contact with the pump tube M5019 (this state is hereafter referred to as a "non-pressure contact state). Then, the series of suction recovery operations are completed.

As described above, in this example, the tube pump M5100 is driven between the points of time ta and tb to bring the pump roller M5018 into pressure contact with the pump tube M5019. Subsequently, the valve lever M5038 closes the valve rubber M5036, and at the point of time tc, the tube pump M5100 is driven again. The reason why the tube pump M5100 is driven according to two steps is shown below.

The active force from the roller damper M5016 is required to move the pump roller M5018 along the movement groove M5020*b* of the pump roller holder M5020 from a position where it is not in pressure contact with the pump tube M5019 (this position is hereafter referred to as a "non-contact pressure position") to the contact pressure position. In addition, the amount of rotation required for the tube pump M5100 to move the pump roller M5018 to the pressure contact position is varied by about 180° depending on the initial position of the pump roller M5018. Additionally, since this example omits the detection means for detecting the position of the pump roller M5018, the amount of rotation of the tube pump M5100 cannot be controlled depending on the initial position of the pump roller M5018. It is then assumed that the tube pump M5100 is simply driven in the arrow F1 direction after the valve rubber M5036 has been closed as in the above described conventional example in FIG. 25. In this case, the amount of rotation of the tube pump M5100 from the start of its rotation until it starts to squeeze the pump tube M5019 after the pump roller M5018 has moved to the contact pressure position, that is, the amount of rotation of the tube pump M5100 from a point of time when the driving is started until a point of time when pressure is generated. Accordingly, under such an assumption, the amount of pressure generated when the tube pump is rotated by a predetermined amount, is significantly varied, and thus the amount of ink sucked and ejected is significantly varied.

On the contrary, in this embodiment, at the point of time tc when the tube pump M5100 is redriven, the pump roller M5018 is already in pressure contact with the pump tube M5019. Consequently, the tube pump M5100 can squeeze the pump tube M5019 to generate pressure therein at the point of time tc. That is, the period of time when pressure is generated by the tube pump M5100 can be accurately determined. The valve rubber M5036 is also closed before the redriving time tc. Thus, this embodiment is not affected by variations in the operation time of the valve rubber M5036 from the start of movement of the valve lever M5038 and valve rubber M5036 until the valve rubber M5036 is completely closed. That is, the period of time when pressure is generated by the tube pump M5100 is set without being affected by variations in the operation time of the valve rubber M5038 resulting from mechanical factors.

Furthermore, once the pump roller M5018 has rotated in the arrow F1 direction by a fixed amount after the redriving time tc, the ejection rollers M2003 are reversely rotated to open the valve rubber M5036. Consequently, the amount of negative pressure generated by the tube pump M5100 or the amount of ink sucked and ejected can be adequately determined and variations in these amounts can be minimized, regardless of the initial position of the pump roller M5018.

Second Embodiment

Figure 24:
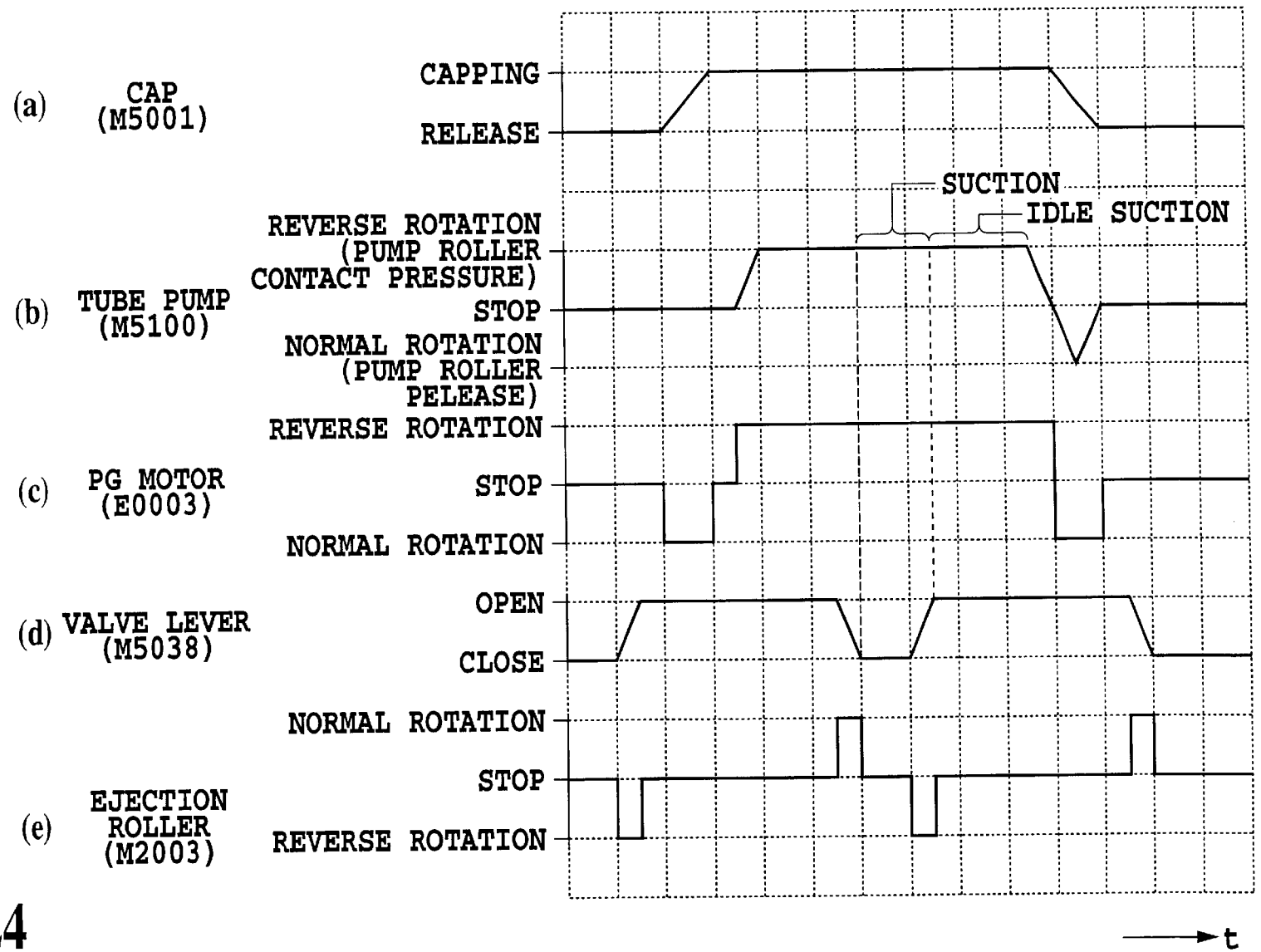
FIG. 24 is a timing chart useful for explaining the operation of the tube pump according to a second embodiment of the present invention.

FIG. 24 is a timing chart useful for explaining the operation of the pump tube M5100 in a pressure generating apparatus according to a second embodiment of the present invention.

If the amount of time required for the opening and closing operations of the valve lever M5038 and valve rubber M5036 is too short to affect the total amount of time required for the tube pump M5100 to generate pressure, the tube pump M5100 need not be driven according to two steps as shown in FIG. 24. That is, when the valve lever M5038 closes the valve rubber M5036, the driving of the tube pump M5100 need not be stopped. Accordingly, a negative pressure can be generated depending on the period of time when the valve rubber 5036 is closed. As a result, effects similar to those of the above described first embodiment can be obtained, and the period of time when the tube pump M5100 is driven can also be reduced.

OTHER EMBODIMENTS

The pressure generating apparatus according to the present invention is widely applicable as printing apparatuses and pressure supply sources for various apparatuses using pressure. In addition, the means for switching to the state where pressure from the tube pump can or cannot be introduced into the pressure introduction section such as the cap may be configured in various manners. For example, an opening and closing valve may be interposed in a pressure introduction path between the tube pump and the pressure introduction section such as the cap. Alternatively, the pressure introduction section may introduce a positive pressure from the tube pump.

The present invention can be effectively used in an aspect where thermal energy generated by a thermoelectric converter is used to cause film boiling in the liquid to generate bubbles therein.

The present invention has been described in detail with respect to various embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A pressure generating apparatus including a tube pump for, when a pressurization member is moved in a predetermined direction, squeezing said tube with said pressurization member coming into pressure contact with an elastic tube, thereby generating in said tube a pressure to be introduced into a pressure introduction section, said apparatus comprising:

switching means for switching to a state where the pressure from said tube pump can or cannot be introduced into said pressure introduction section; and control means for allowing said switching means to switch to the state where the pressure from said tube pump can be introduced into said pressure introduction section after said pressurization member has moved a predetermined amount in said predetermined direction without stopping the movement of said pressurization member after said pressurization member has already moved said predetermined amount, followed by generating in said tube the pressure requested by said pressure introduction section and introducing into said pressure introduction section the pressure generated in said tube by said pressurization member moving in said predetermined direction.

2. A pressure generating apparatus as claimed in claim 1, wherein on switching to the state where the pressure from said tube pump can be introduced into said pressure introduction section, said control means temporarily stops the movement of said pressurization member in said predetermined direction.

3. A pressure generating apparatus as claimed in claim 1, wherein said pressurization member, when moved in one direction, squeezes said tube after coming in pressure contact with said tube and does not come in pressure contact with said tube when moved in the other direction.

4. A pressure generating apparatus as claimed in claim 1, wherein said tube is disposed along a circular pressure contact guide, and said pressurization member rotates in a manner drawing a trace extending substantially along said pressure contact guide.

5. A pressure generating apparatus as claimed in claim 4, including a plurality of said pressurization members, wherein at least one of said pressurization members is constantly in contact with said tube disposed circularly along said pressure contact guide to enable pressure to be continuously generated.

6. A pressure generating apparatus as claimed in claim 4, including a rotating member that can rotate around a circular arc center of said tube disposed circularly along said pressure contact guide, said rotating member including said pressurization member in a manner such that a distance between said pressurization member and a rotating center of said rotating member can vary.

7. A pressure generating apparatus as claimed in claim 6, wherein said rotating member has a holder member attached thereto and which can vary its distance from the rotating center of said rotating member, said holder member including said pressurization means.

8. A pressure generating apparatus as claimed in claim 6, wherein said pressurization means is shaped like a roller, wherein a holder member of said rotation member has a groove extending in a direction that varies a distance from the rotating center of said rotating member, and said roller-shaped pressurization means is movably and rotatably provided in said groove.

9. A pressure generating apparatus as claimed in claim 8, including an urging member for effecting a force that urges said pressurization means, which has been rotated to a position where it is not opposed to said pressure contact guide, away from the rotating center of said rotating member.

10. A pressure generating apparatus as claimed in claim 1, wherein said pressure introduction section has a cap into which a negative pressure generated by said tube pump is introduced.

11. A pressure generating apparatus as claimed in claim 10, wherein said switching means is an opening and closing valve interposed in an air communication path for allowing an interior of said cap to communicate with atmosphere, wherein when said air communication path is opened, the negative pressure to be introduced into said cap is released to the air, with the result that the negative pressure cannot be introduced into said cap, and when said air communication path is closed, the negative pressure to be introduced into said cap is not released to the air, with the result that the negative pressure can be introduced into said cap.

12. A printing apparatus that can print an image on a printing medium using a printing head capable of ejecting inks and that includes recovery means for effecting pressure on said printing head to eject ink that does not contribute to printing, from said printing head, said apparatus comprising:

said pressure generating means as claimed in claim 1 as a supply source of the pressure that is introduced into said recovery means.

13. A printing apparatus as claimed in claim 12, wherein said recovery means includes a cap that can cap an ink ejection port of said printing head, to introduce a negative pressure from said tube pump into said cap to suck and eject ink from said ink ejection port.

14. A printing apparatus as claimed in claim 12, wherein said printing head has a thermoelectric converter for generating thermal energy as energy for ejecting ink.

15. A method for controlling a printing apparatus that can print an image on a printing medium using a printing head capable of ejecting ink and that includes recovery means for effecting pressure to said printing head to eject ink that does not contribute to printing, from said printing head, said method comprising the steps of:

providing a tube pump as a supply source of pressure that is introduced into said recovery means;

squeezing, when a pressurization member is moved in a predetermined direction, said tube by said tube pump with said pressurization member coming into pressure contact with an elastic tube, thereby generating in said tube a pressure to be introduced into said recovery means;

switching a state, after said pressurization member has moved a predetermined amount in said predetermined direction without stopping the movement of said pressurization member after said pressurization member has already moved said predetermined amount, to a first state where the pressure from said tube pump can be introduced into said recovery means, from a second state where the pressure from said tube pump cannot be introduced into said recovery means, followed by generating in said tube the pressure requested by said pressure introduction section and introducing into said pressure introduction section the pressure generated in said tube by said pressurization member moving in said predetermined direction.

* * * * *